US005672380A

United States Patent [19]

Uchida et al.

[11] Patent Number: 5,672,380

[45] Date of Patent: Sep. 30, 1997

[54] METHOD FOR PRODUCTION OF PATTERNED SHAPED ARTICLES

[75] Inventors: Hiroshi Uchida, Ashikaga; Mituhiro Onuki, Kiryu; Hideo Watanabe, Ashikaga, all of Japan

[73] Assignee: CCA Inc., Tokyo, Japan

[21] Appl. No.: 419,239

[22] Filed: Apr. 10, 1995

Related U.S. Application Data

[62] Division of Ser. No. 115,546, Sep. 3, 1993, Pat. No. 5,429, 676.

[51] Int. Cl.[6] ..... B05D 1/26; B05D 1/36

[52] U.S. Cl. ..... 427/180; 427/198; 427/201; 427/350

[58] Field of Search ..... 427/180, 184–189, 427/196, 198, 202–203, 350, 201, 264; 264/33, 260, 284, 245, 266; 222/129, 132, 145.7

[56] References Cited

U.S. PATENT DOCUMENTS

| | | | |
|---|---|---|---|
| 1,900,598 | 3/1933 | Doyan | 427/187 |
| 4,076,567 | 2/1978 | Yoshikawa et al. | 156/219 |
| 4,773,568 | 9/1988 | Schaefer | 222/175 |
| 5,121,329 | 6/1992 | Crump | 364/468 |

FOREIGN PATENT DOCUMENTS

| | | |
|---|---|---|
| 2215266 | 9/1989 | United Kingdom . |

*Primary Examiner*—Shrive Beck
*Assistant Examiner*—Fred J. Parker
*Attorney, Agent, or Firm*—Oblon, Spivak, McClelland, Maier & Neustadt, P.C.

[57] ABSTRACT

An apparatus for simultaneously supplying at least two kinds of particles onto a given surface, includes a movable supply head having at least one partition member for partitioning the at least two kinds of particles and defining at least two supply ports in conjunction with the supply head; and a device for introducing the at least two kinds of particles into the supply head. A patterned shaped article is produced by a method using the apparatus. The method includes simultaneously supplying the two supply ports of the supply head, with the one partition member abutting on the given surface, thereby forming a pattern course on the given surface, and allowing the pattern course to set into an integral mass.

3 Claims, 26 Drawing Sheets

METHOD FOR PRODUCTION OF PATTERNED SHAPED ARTICLES

This is a Division, of application Ser. No. 08/115,546 filed on Sep. 3, 1993, now U.S. Pat. No. 5,429,676.

BACKGROUND OF THE INVENTION

1. Field of the Invention

This invention relates to methods for producing patterned shaped articles including patterned concrete shaped articles, patterned artificial stone shaped articles, raw products for patterned ceramic shaped articles, patterned ceramic shaped articles, patterned metal shaped articles, impasto shaped articles, plastic shaped articles, shaped foodstuffs, etc. The term "particles" used throughout herein include particles, grains and granules either alone or in combination with each other.

2. Description of the Prior Art

The conventional method of providing part or all of a paved surface constituted of paving blocks with pattern indicating, for example, a stop intersection or other such traffic control mark has been either to apply paint to the surface in the desired pattern or to inlay the surface with another material in the desired pattern.

However, since the patterns painted on part or all of the surface from pedestrians' shoes and/or vehicle tires and the like, they quickly wear off and have to be redone at frequent intervals, at a considerable cost in terms of labor and materials. Where the pattern is formed by inlaying, the work itself is troublesome and very costly.

The present invention has been accomplished to overcome the drawbacks encountered by the conventional method.

One object of the present invention is to provide an apparatus for supplying particles of prescribed thickness onto a given surface.

Another object of the present invention is to provide an apparatus for supplying particles of prescribed thickness onto a given surface and provided with a function to remove the particles by suction.

An object of the present invention is to provide methods for producing patterned shaped articles.

To attain the above objects, according to the present invention there is provided a method for producing a patterned shaped article using the aforementioned apparatus, comprising the steps of simultaneously supplying the at least two kinds of particles onto the given surface through the at least two supply ports of the supply head, with the at least one partition member abutting on the given surface, thereby forming a pattern course on the given surface; and allowing the pattern course to set into an integral mass.

The above and other objects, characteristic features and advantages of this invention will become apparent to those skilled in the art from the disclosure of the invention to be given hereinbelow with reference to the accompanying drawings.

DESCRIPTION OF THE PREFERRED EMBODIMENTS

This invention will now be described with reference to the illustrated embodiments.

Figure 1:
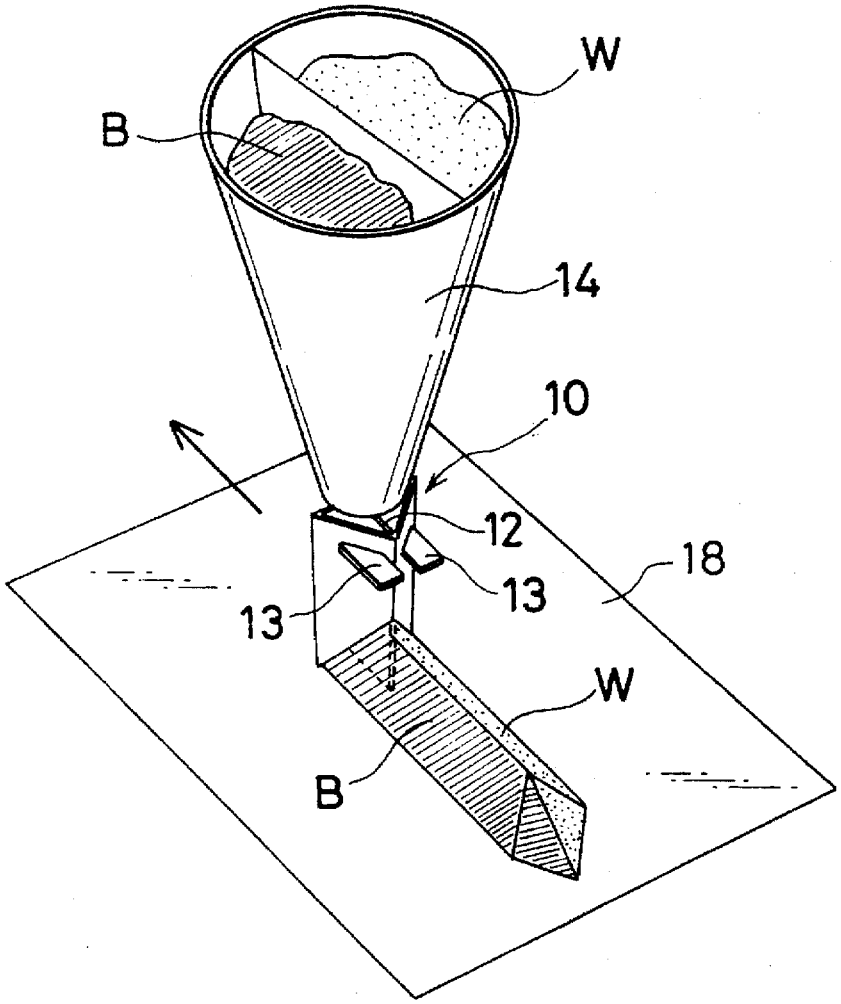
FIG. 1 is a perspective view showing a first embodiment of an apparatus for simultaneously supplying particles of prescribed thickness onto a given surface according to this invention.
Figure 2:
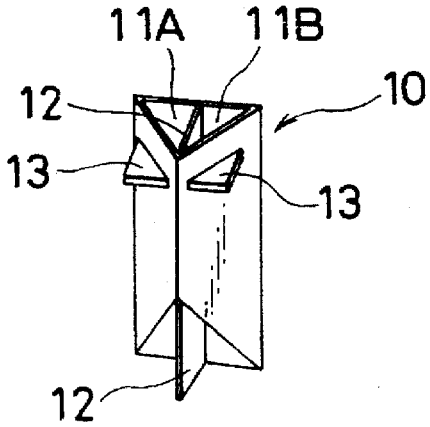
FIG. 2 is a perspective view showing a supply head usable for the embodiment shown in FIG. 1.

FIG. 1 and FIG. 2 illustrate the first embodiment of an apparatus for simultaneously supplying particles of prescribed thickness onto a given surface according to the present invention.

This apparatus comprises a supply head 10 of a triangular sectional profile divided into two equal triangles by a partition member 12 to define two supply ports 11A and 11B from which two kinds of particles B and W (blue and white materials, for example) are to be simultaneously supplied onto a given surface 18 and which are openable and closable by means of manually operable gates or shutters 13, and a manually operable hopper-shaped vessel 14 connected to the supply head 10 so that relative rotation of 180° is permitted. The interior of the vessel 14 is divided into two chambers accommodating therein two kinds of particles which are supplemented into the supply ports 11A and 11B of the supply head 10.

A pattern is formed on a given surface 18 such as a sheet etc. by holding the supply head 10 and vessel 14 with the lower end of the supply head disposed in contact with or slightly above the given surface, supplying the two kinds of particles different in color, for example, onto the given surface while moving the supply head 10 and vessel 14 so as to trace the pattern to be formed and, if necessary, sometimes closing one of the supply ports 11A and 11B with the gate 14.

Figure 3:
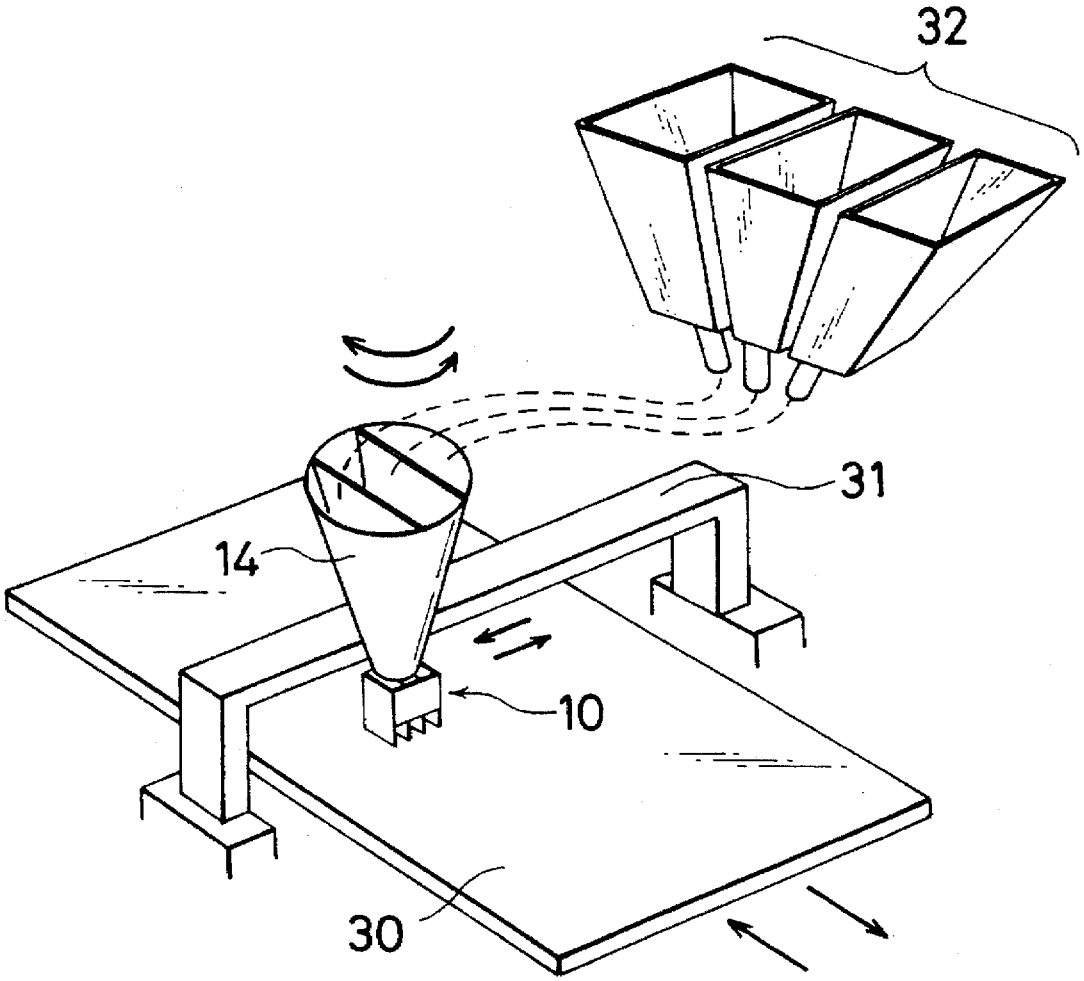
FIG. 3 is a perspective view showing a modification of the apparatus shown FIG. 1.
Figure 4:
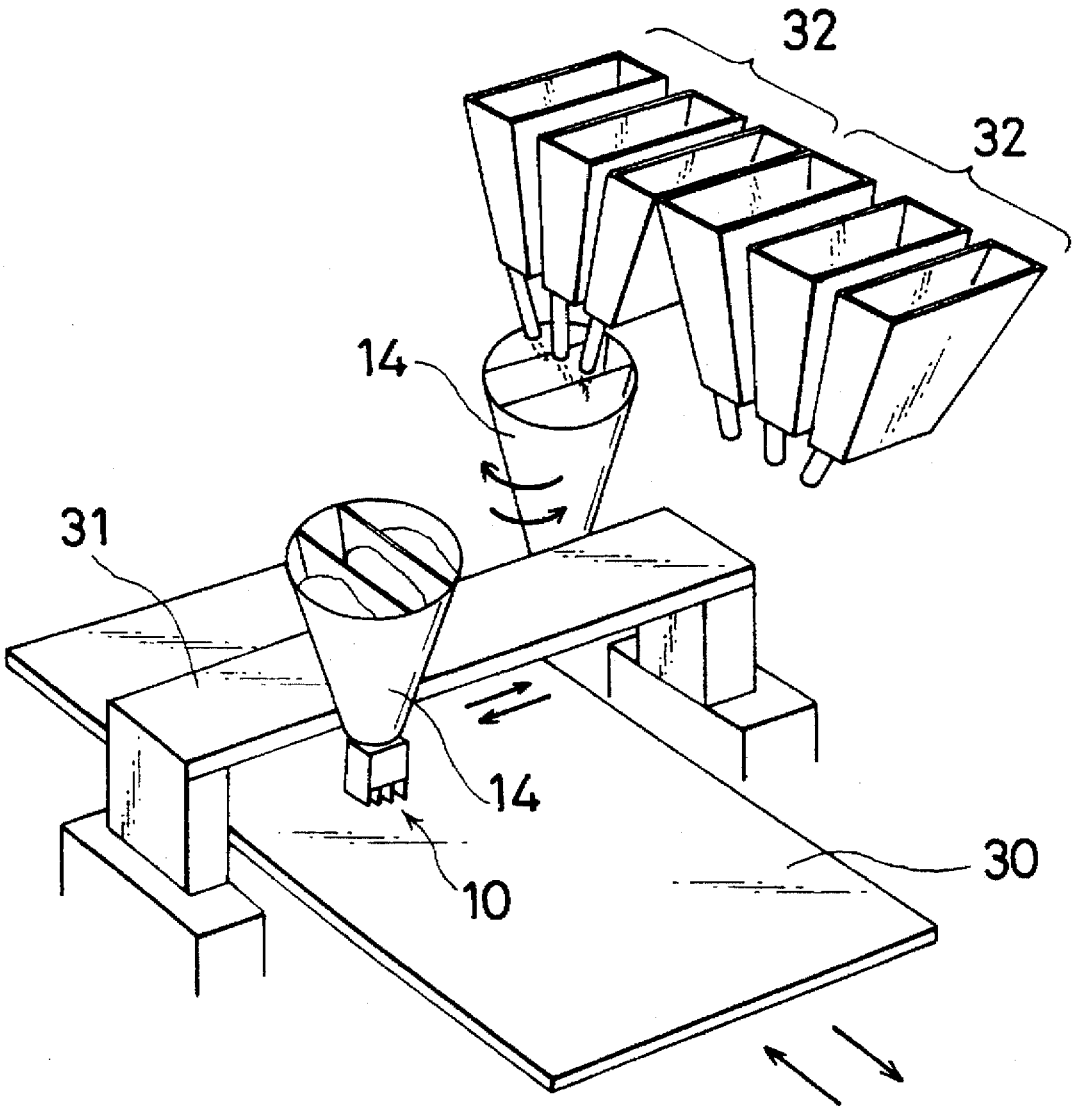
FIG. 4 is a perspective view showing another modification of the apparatus shown in FIG. 1.

FIG. 3 and FIG. 4 illustrate first and second modifications of the embodiment shown in FIG. 1, utilizing a sliding pair coordinate system.

Figure 5:
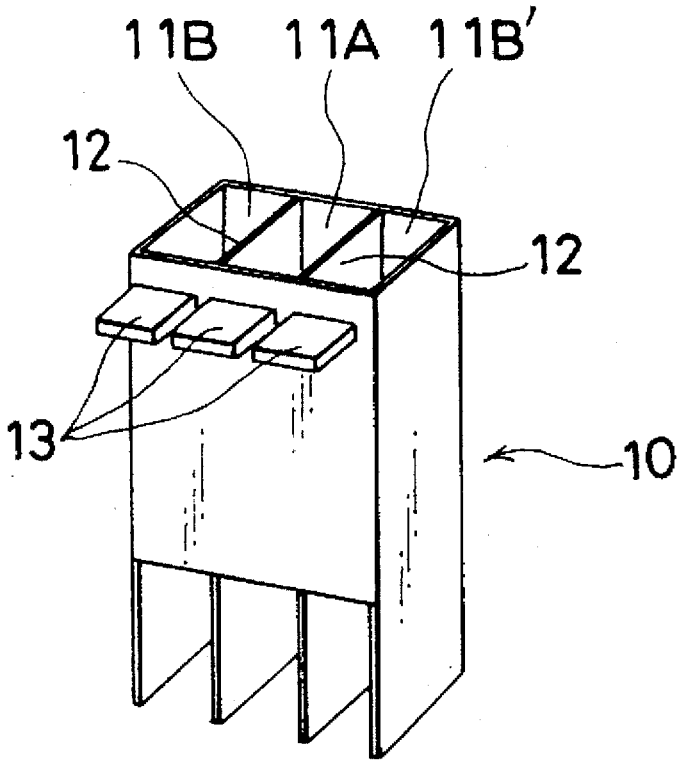
FIG. 5 is a perspective view showing a supply head usable for the modifications shown in FIG. 3 and FIG. 4.

As shown in FIG. 5, there is used in the two modifications a supply head 10 of a rectangular sectional profile divided into three equal rectangles by two partition members 12 to define three supply ports 11A, 11B and 11B' from which three kinds of particles are to be simultaneously supplied onto the surface of a table 30 (a given surface) and which are openable and closable by means of gates 13. In these modifications, a small-sized hopper-shaped vessel 14 accommodating therein three kinds of particles is connected to the supply head 10. A combination of supply head 10 and vessel 14 is mounted on a gate-shaped frame 31 straddling a table 30 so that the combination is rotatable and reciprocative along the frame 31. At one end of the frame 31 particles are supplemented from a large-sized vessel 32 into the small-sized vessel 14. As shown in FIG. 3, a pattern is formed by supplying the three kinds of particles via the supply ports onto the surface of the table 30 as a given surface, with the supply head 10 disposed in contact with or slightly above the given surface, while rotating and laterally moving the combination and moving the table 30 longitudinally and, if necessary, selectively opening and closing the supply ports by the gates 13. In the modification shown in FIG. 4, two sets of supply heads 10, small-sized vessels 14 and large-sized vessels 32 are disposed on the opposite sides of the gate-shaped frame 31 so as to realize the formation of a pattern comprising six kinds of particles.

In the two modifications, means for driving the table 30, combination of supply head 10 and small-sized vessel 14, and gates 13 have been omitted from illustration.

Figure 6:
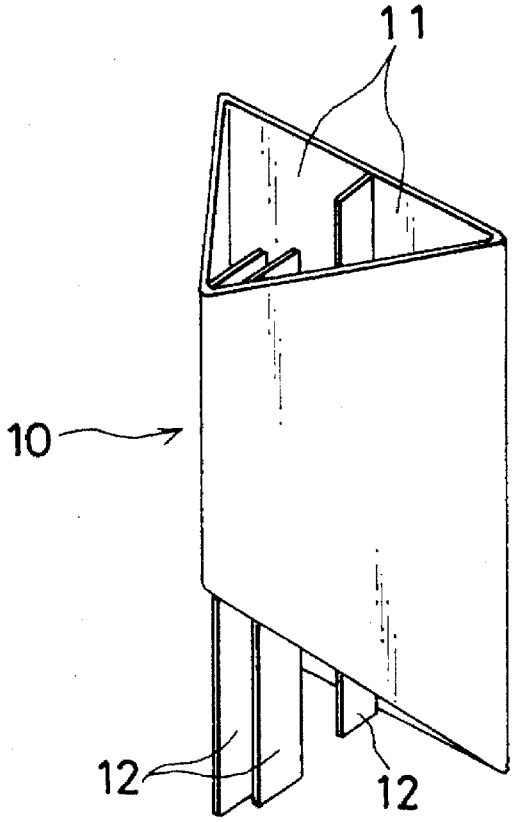
FIG. 6 is a perspective view showing another example of supply head usable for this invention.
Figure 7:
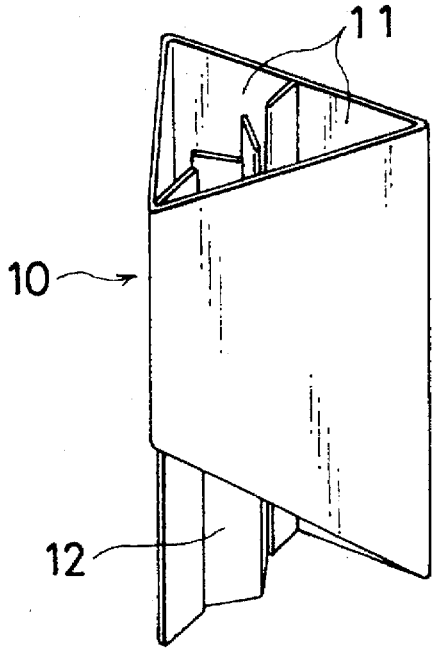
FIG. 7 is a perspective view showing still another example of supply head usable for this invention.
Figure 8A:
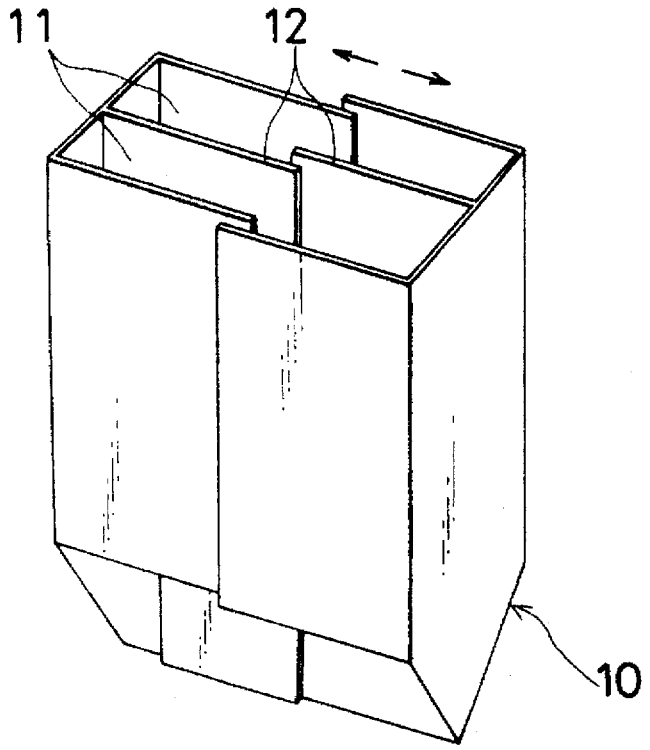
FIG. 8(A) is a perspective view showing yet another example of supply head usable for this invention.

Supply heads 10 shown in FIG. 6, FIG. 7 and FIG. 8(A) may be used instead of those shown in FIG. 2 and FIG. 5.

The supply head 10 shown in FIG. 6 has a partition member 12 divided into three pieces, with the middle piece movable, thereby causing two supply ports 11 to communicate with each other, whereby a linear pattern having two colors of particles admixed can be formed and, by returning the middle piece to its original position, a clear-cut two-line pattern of two colors can be formed.

The supply head 10 shown in FIG. 7 has a partition member 12 divided into four pieces which are swingable. When the four pieces are swung to be in a zigzagged form, for example, a zigzagged pattern having two colors of particles admixed can be formed and, by causing the four pieces to restore to their respective original positions in a straight form, a clear-cut two-line pattern of two colors can be formed.

Figure 8B:
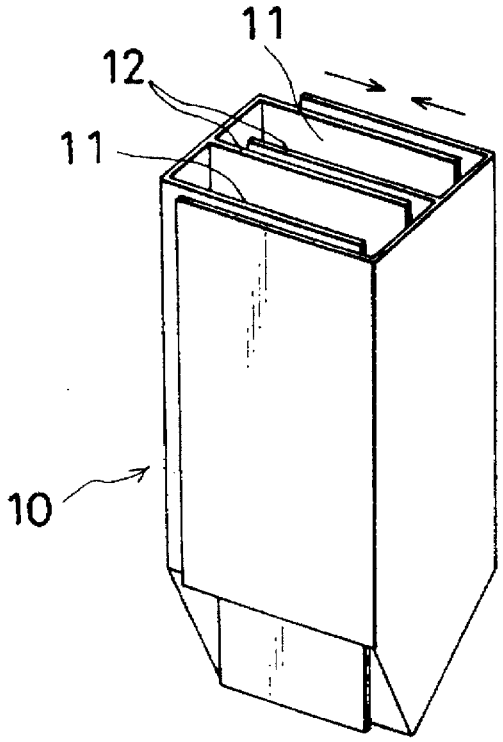
FIG. 8(B) is a perspective view showing the supply head of FIG. 8(A) in a contracted state.

The supply head 10 shown in FIG. 8(A) and FIG. 8(B) is of a slide type and makes its length adjustable.

Means for moving the partition members and sliding means of these examples of supply heads have been omitted from illustration.

Though not shown in the drawings, a supply head having a deformable partition member or other types of movable supply heads may be used instead. In this case, it is possible to form various kinds of complex and highly precise patterns including a continuous line pattern comprising a clear-cut line and a color-admixed line, a continuous line comprising a lightface line and a boldface line, etc.

Figure 9:
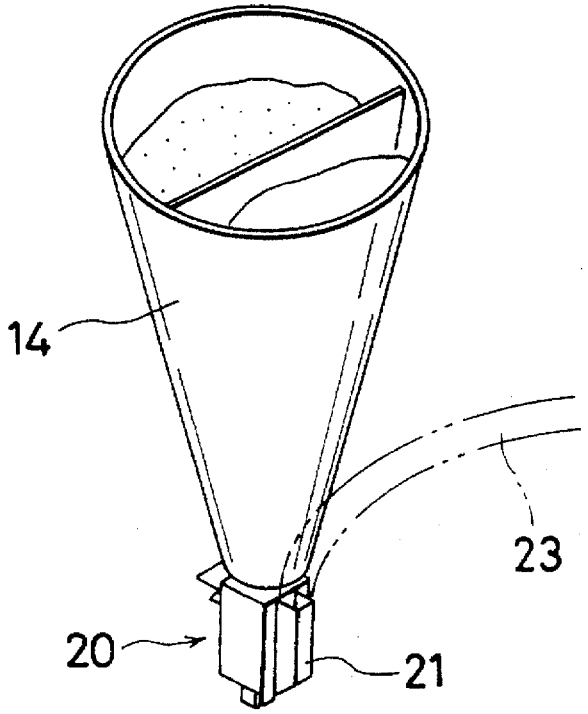
FIG. 9 is a perspective view showing a second embodiment of the apparatus according to this invention, which is provided further with a function to remove the particles by suction.

FIG. 9 shows the second embodiment of the apparatus for continuously supplying particles of prescribed thickness onto a given surface according to this invention, which is provided with a function to remove part of the particles by suction.

Figure 10:
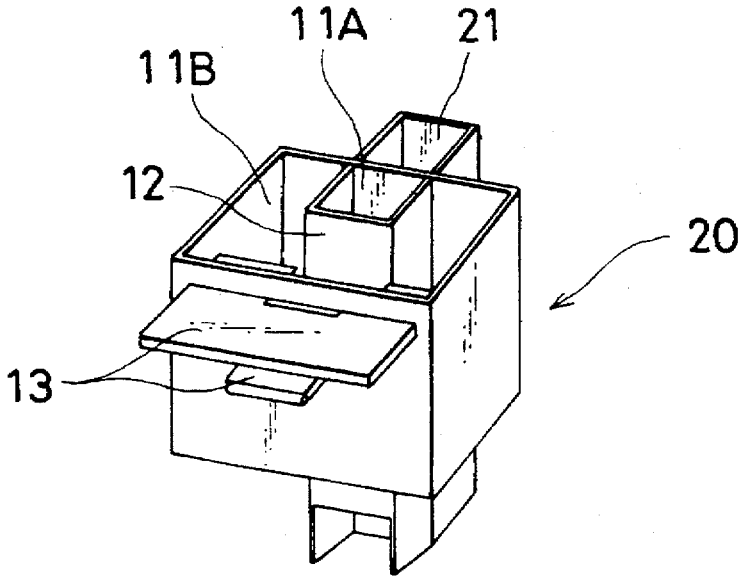
FIG. 10 is a perspective view showing a supply-suction head usable for the embodiment shown in FIG. 9.

To be specific, the apparatus comprises a supply-suction head 20 and a manually operated hopper-shaped vessel 14 disposed on the supply-suction head 20 and containing therein two kinds of particles. As shown in FIG. 10, the supply-suction head 20 has a partition member 12 to define two supply ports 11A and 11B, one of which is square in cross section and the other of which is concave in cross section to surround the three sides of the square of the one supply port 11A, for simultaneously supplying two kinds of particles therefrom, a suction port 21 in contact with the remaining side of the square of the supply port 11A, and manually operated gates 13 for opening and closing the supply ports 11A and 11B and suction port 21. The suction port 21 is connected to a suction device (not shown) via a tube 23.

FIG. 11(A), FIG. 11(B), FIG. 13, FIG. 15, FIG. 17(A) and FIG. 17(B) illustrate the modifications of the embodiment shown in FIG. 9.

Figure 11A:
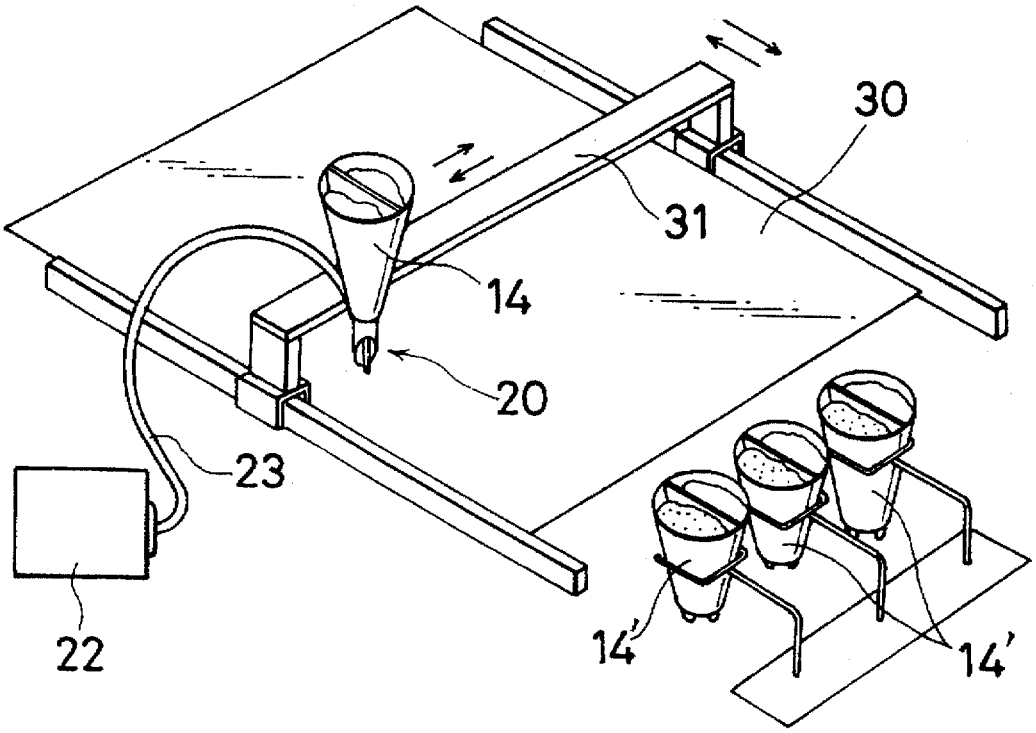
FIG. 11(A) is a perspective view showing a modification of the apparatus shown in FIG. 9, utilizing a parallel linkage system.
Figure 11B:
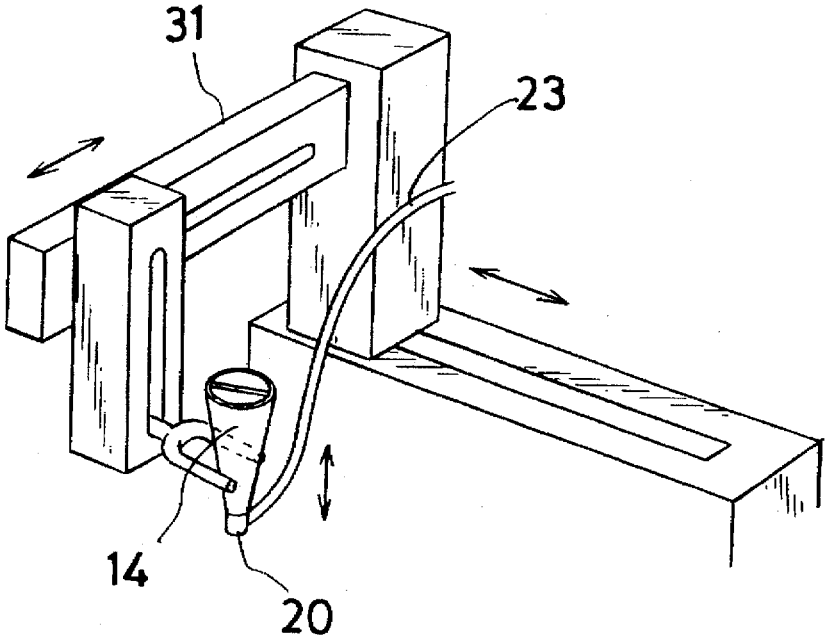
FIG. 11(B) is an explanatory view showing a cartesian coordinate robot usable instead of the parallel linkage system of FIG. 11(A).
Figure 12:
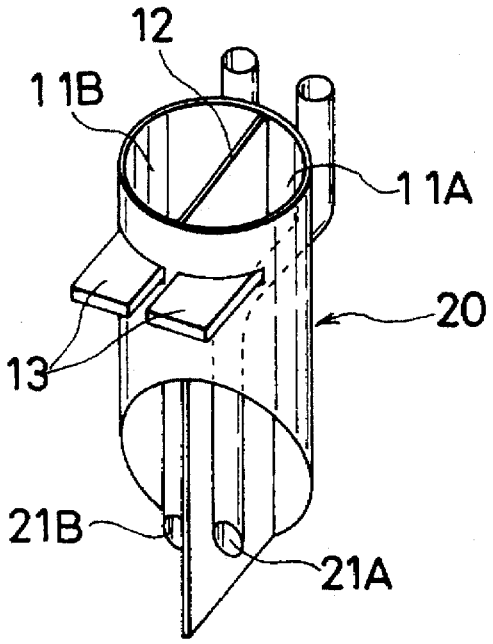
FIG. 12 is a perspective view showing a supply-suction head usable for the modification shown in FIG. 11(A) and FIG. 11(B).

In the modification of FIG. 11(A) utilizing a parallel linkage system, the apparatus has a supply-suction head 20 of FIG. 12 having a partition member 12 to define two semicircular supply ports 11A and 11B for simultaneously supplying two kinds of particles of prescribed thickness onto a given surface, two suction ports 21A and 21B provided on the opposite sides of the partition member 12 for removing part of the supplied particles by suction, and gates 13 for opening and closing the supply ports 11A and 11B. A small-sized hopper-shaped vessel 14 containing therein two kinds of particles to be supplied into the supply ports 11A and 11B of the supply-suction head 20 is provided with a gate (not shown) and detachably combined with the supply-suction head 20. The combination is mounted on a gate-shaped frame 31 straddling a table 30 and slidably movable along rails provided on the opposite sides of the table 30 so that the combination is rotatable and laterally movable along the gate-shaped frame 31. The suction ports 21A and 21B are connected via a tube 23 to a suction device 22 at a distance from the gate-shaped frame 31. When the frame 31 moves along the rails to its one terminal position, the vessel 14 is detached from the supply-suction head 20 and another vessel 14' is substituted. As shown in FIG. 11(B), a cartesian coordinate robot can be used in place of the parallel linkage system of FIG. 11(A).

Means for driving the gate-shaped frame 31, hopper-shaped vessel 14, supply-suction head 20 and gates 13 have been omitted from illustration.

Figure 13:
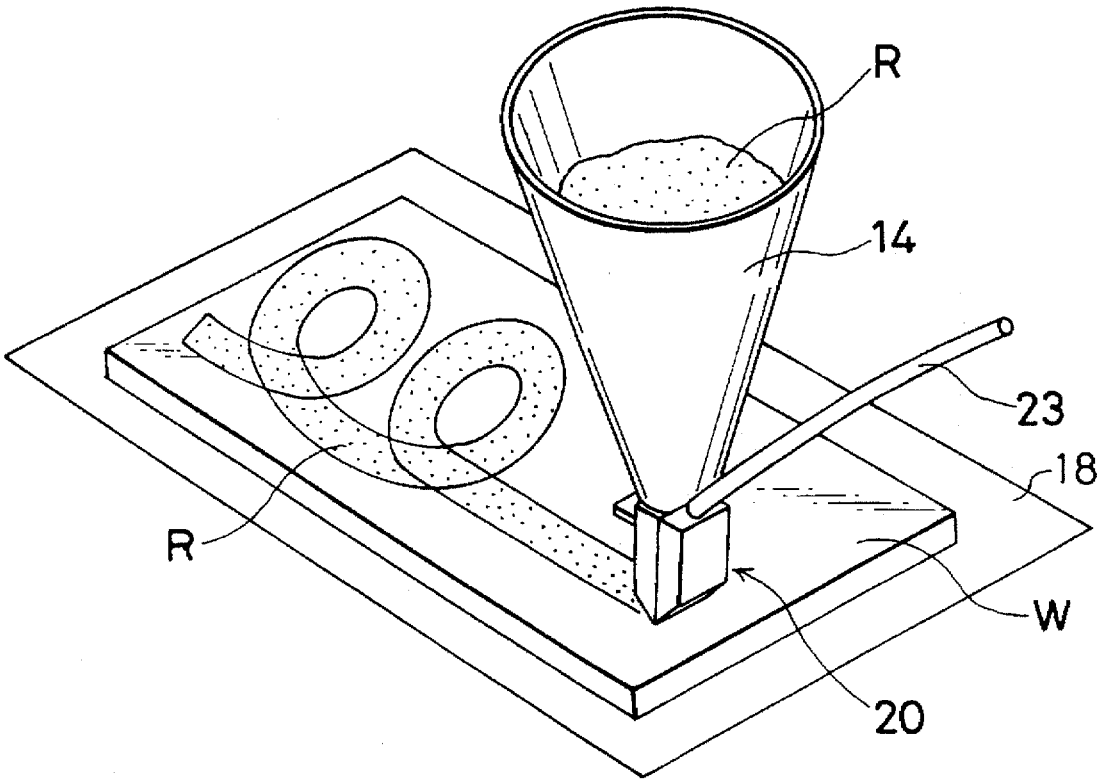
FIG. 13 is a perspective view showing another modification of the apparatus shown in FIG. 9.
Figure 14A:
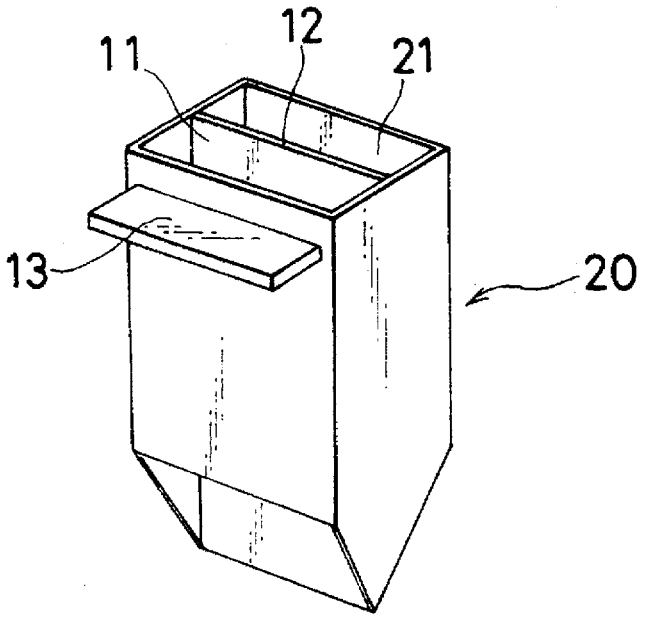
FIG. 14(A) is a perspective view showing a supply-suction head usable for the modification shown in FIG. 13.
Figure 14B:
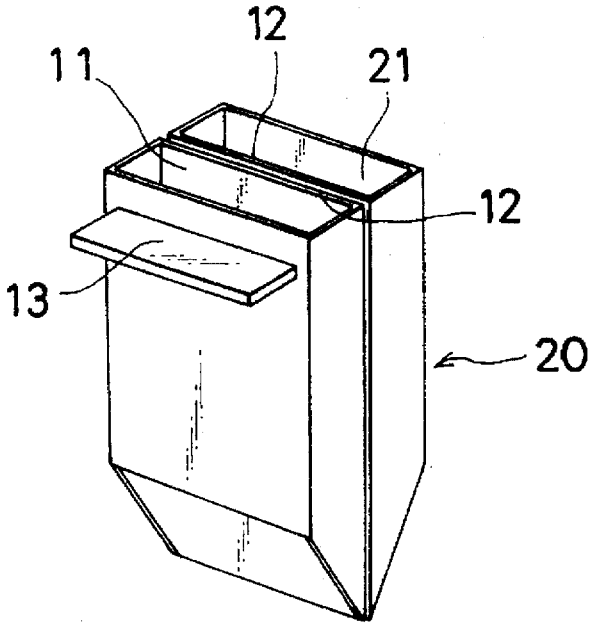
FIG. 14(B) is a perspective view showing a modification of the supply-suction head shown in FIG. 14(A).

In the second modification of FIG. 13, the apparatus has a supply-suction head 20 of FIG. 14(A) having a partition member 12 to define a supply port 11 for supplying particles onto a given sheet 18 on a table and a suction port 21 for removing part of the supplied particles by suction, and a manually operated gate 13 for opening and closing the two ports. The two ports 11 and 21 are of the same size and have a rectangular sectional profile. A manually operated hopper-shaped vessel 14 is mounted on the supply-suction head 20. As shown in FIG. 14(B), the supply-suction head 20 may be constituted by two separate members, one having a supply port 11 and the other having a suction port 21. The suction port 21 is connected via a tube 23 to a suction device (not shown). In this modification, the supply and suction ports 11 and 21 have the same height and are disposed across the partition member 12 extending in a direction perpendicular to the direction in which the supply-suction head 20 advances. However, this arrangement is not limitative. For example, the two ports may be disposed at a distance, offset in vertical position and formed in any other shape.

Figure 15:
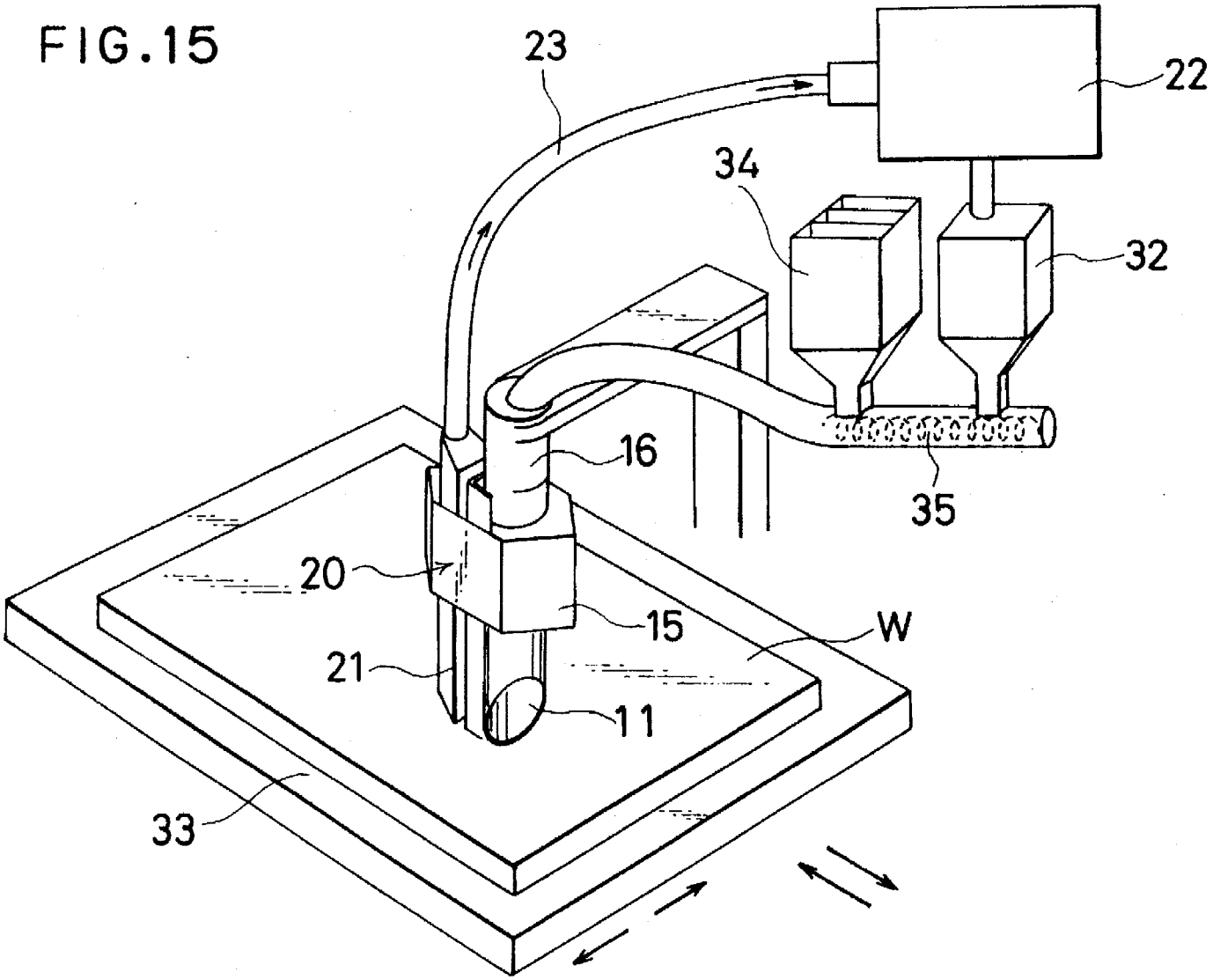
FIG. 15 is a perspective view showing still another modification of the apparatus shown in FIG. 9.
Figure 16:
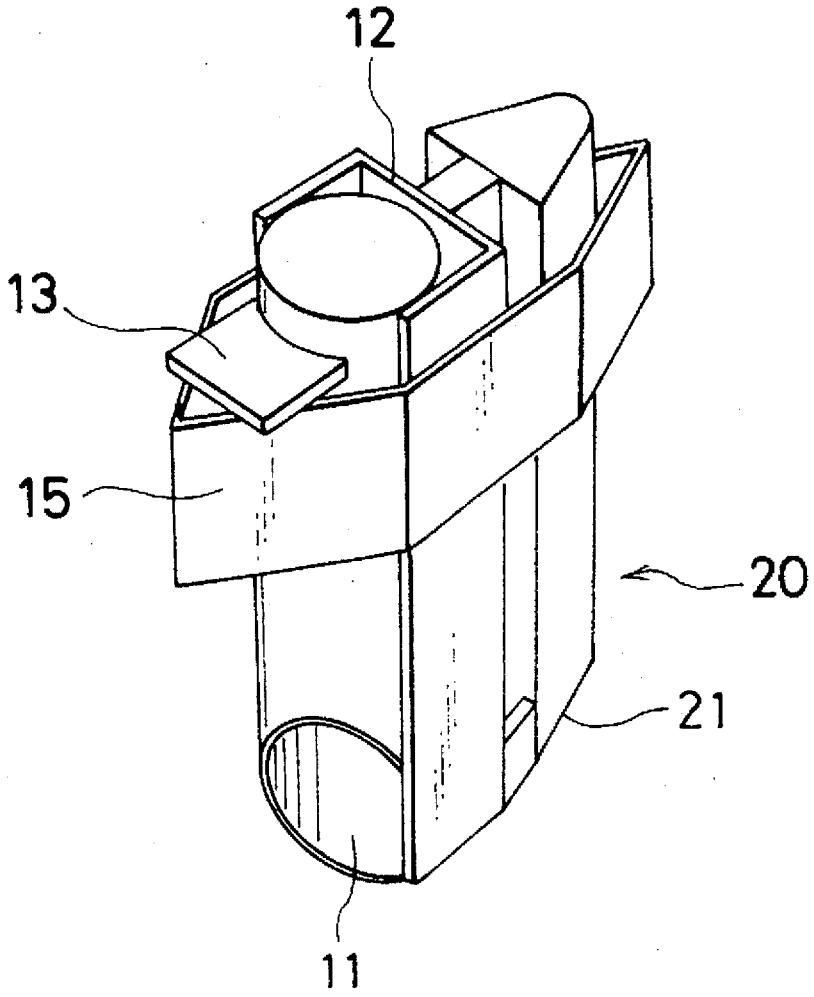
FIG. 16 is a perspective view showing a supply-suction head usable for the modification shown in FIG. 15.

In the third modification of FIG. 15 utilizing a cartesian coordinate system, the apparatus has a supply-suction head 20 of FIG. 16 having a U-shaped partition member 12 embracing a supply port 11 circular in cross section and separating the supply port 11 from a suction port 21 triangular in cross section, an auxiliary member 15 which is a vertically slidable enclosure member allowing a combination of supply and suction ports to temporarily expand when sliding downward, and electrically actuating gates 13 for opening and closing the supply and suction ports 11 and 21. A vessel 16 on the supply-suction head 20 is disposed at a prescribed position above an electrically operated table 33. The suction port 21 is rotatable about the supply port 11 and is connected to a suction device 22 disposed aside of the table 33 via a tube 23. The material sucked by the suction device 22 is guided into a vessel 32 for particles disposed beneath the suction device 22. A vessel 34 for coloring materials is disposed near the vessel 32. The material from the vessel 32 is introduced into a screw line mixer 35 and colored by the coloring materials introduced from the vessel 34 into the mixer 35, and the coloring material is fed into the supply port 11. By interlocking the table 33 and the supply-suction head 20, supply and suction of the materials are carried out substantially at the same time to form a pattern. Means for driving the table 33, suction port 21, gates 13, etc. have been omitted from illustration. In this modification, the supply and suction ports 11 and 21 are disposed across the partition member 12 and the enclosure member is used as an auxiliary member 15. The arrangement and shapes of the two ports are not limitative. For example, the two ports may be disposed at a distance and offsest in vertical position. The shape of the enclosure member is not limitative but may be of any other shape. The position of the auxiliary member 15 is not limitative.

Figure 17A:
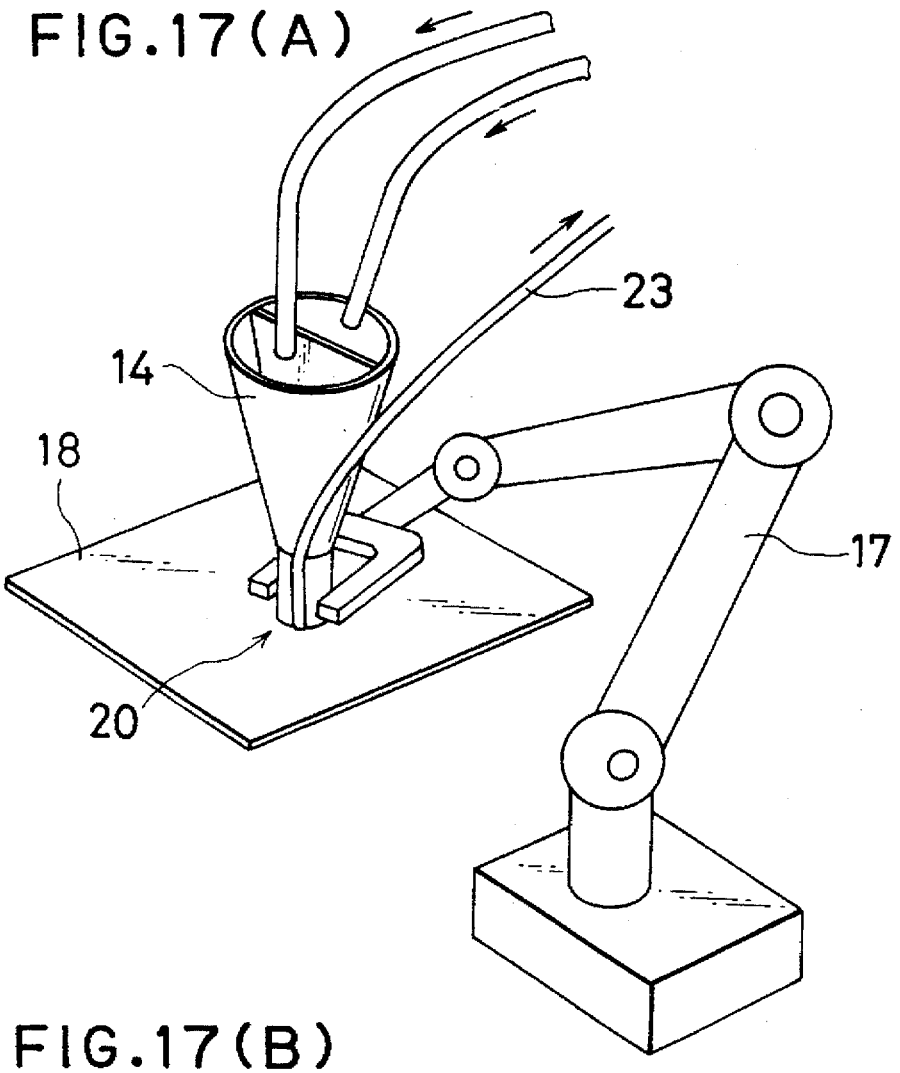
FIG. 17(A) is a perspective view showing yet another modification of the apparatus shown in FIG. 9, utilizing an articulated coordinate robot.
Figure 17B:
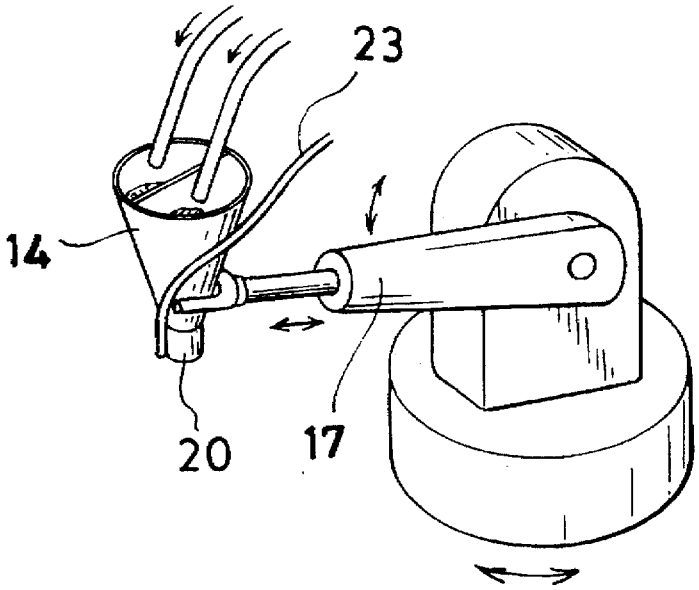
FIG. 17(B) is an explanatory view showing a polar coordinate robot usable instead of the articulated coordinate robot of FIG. 17(A).

In the fourth modification of FIG. 17(A), the apparatus of manually operated type is used in association with an articulated coordinate robot 17 serving to position the supply-suction head 20. This articulated coordinate robot 17 can also be used in the first embodiment of FIG. 1 and the second modification of FIG. 13 because these are also of manually operated type. Further, a polar coordinate robot shown in FIG. 17(B) is usable in place of the articulated coordinate robot of FIG. 17(A).

Figure 18:
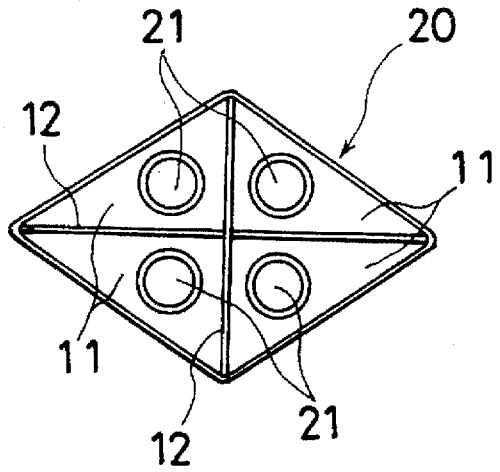
FIG. 18 is a plan view showing another example of supply-suction head usable for a further modification of the apparatus shown in FIG. 9.
Figure 19:
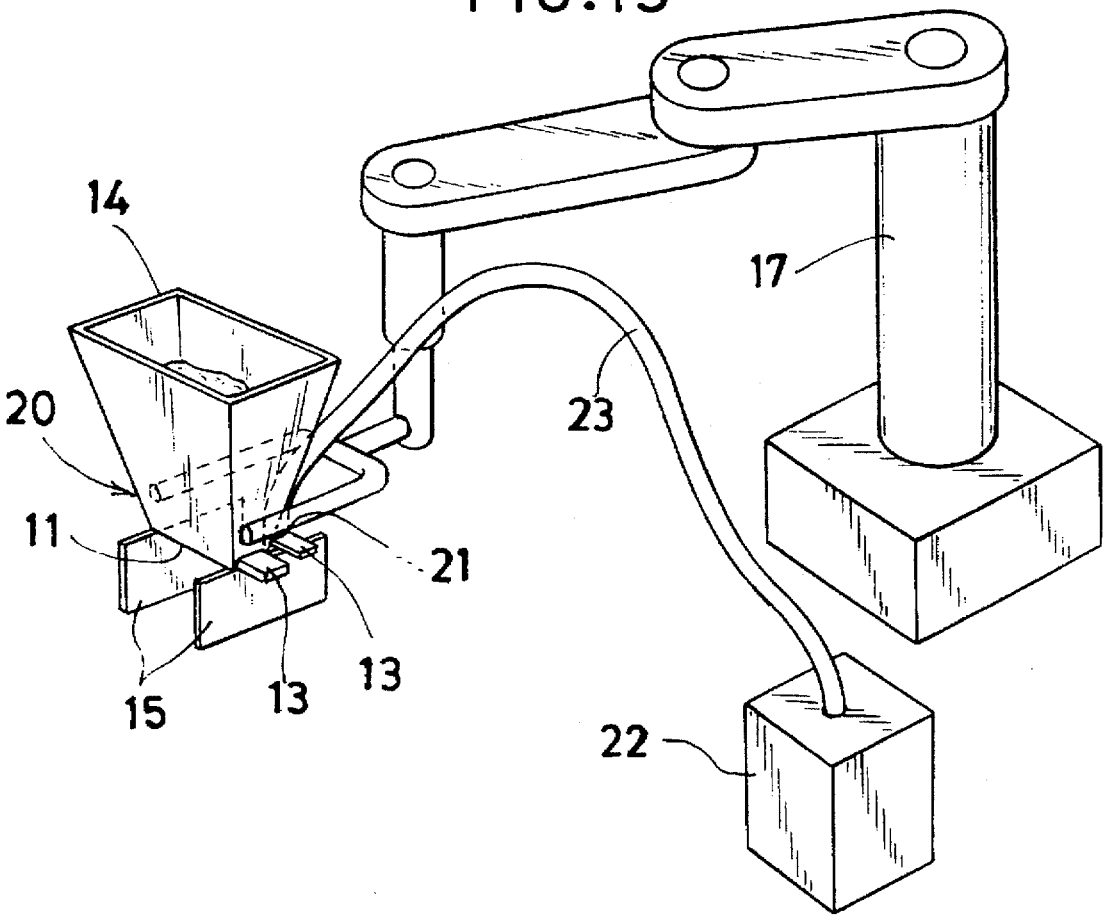
FIG. 19 is a perspective view showing a further modification of the apparatus of FIG. 9, utilizing a cylindrical coordinate robot.
Figure 20:
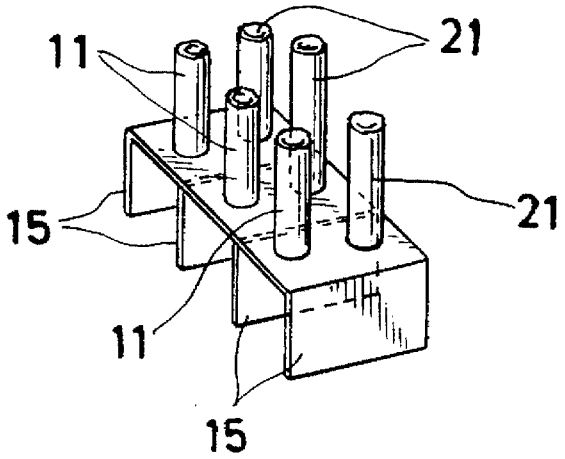
FIG. 20 is a perspective view showing a supply-suction port usable in the modification of FIG. 19.
Figure 21:
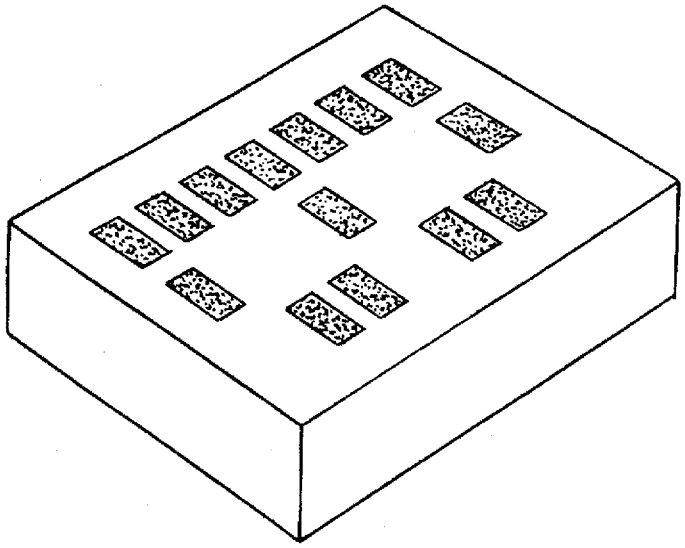
FIG. 21 is an explanatory view showing a patterned shaped article produced by the use of the modification of FIG. 19.

The supply head 10 and supply-suction head 20 are not limited to those shown in the drawings. As shown in FIG. 18, for example, a supply-suction head 20 having four supply ports 11 for supplying four kinds of particles and four suction ports 21 disposed one each in the supply ports 11 may be adopted. As occasion demands, any other shape of supply head or supply-suction head, any other combination of supply heads or supply-suction heads may be adopted. For example, in the apparatus for simulataneously supplying materials, the supply port may be disposed at a position higher than that of the partition member and, in the apparatus having a function to suck up the material, the supply port may be disposed at a position higher than that of the suction port, and vice versa. In addition, the apparatus may further have such an auxiliary member 15 as the enclosure member shown in FIG. 15. The auxiliary member 15 may consist of a pair of parallel plates as shown in FIG. 19 wherein a supply port 11 and a suction port 21 are provided on the upper side between the plates or of a plurality of parallel plates as shown in FIG. 20 wherein a supply port 11 and a suction port 21 are provided between adjacent plates. In the apparatus of FIG. 19, the supply-suction head 20 is moved by a cylindrical coordinate robot 17 to effect suction and supply of the materials in the form of dots, thereby obtaining a shaped article having a dotted pattern as shown in FIG. 21. This apparatus can also provide a shaped article having a linear pattern as shown in FIG. 13. When using the supply-suction head of FIG. 20, since a plurality of pairs of supply ports 11 and suction ports 21 are operated at the same time to effect supply and suction of the materials, a pattern can be formed rapidly. The supply and suction ports may either be integral or be separated from each other. By changing the positions at which the supply port is to be disposed and the shape of the supply port and controlling the amount of materials to be supplied, it is possible to obtain patterned shaped articles of various thicknesses. The thickness of shaped articles to be formed by supplying the materials onto a given surface falls desirably within 100 mm. In using the apparatus having a function to suck up the materials, supply of the material to a recessed portion formed in consequence of suction of the material is desirably effected simultaneously with or immediately after the suction. However, this is by no means limitative and the supply may be effected at an appropriate time after the suction insofar as a given pattern can be formed.

Figure 22:
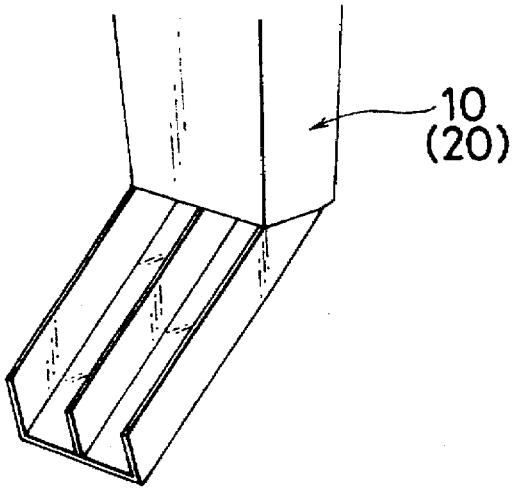
FIG. 22 is a perspective view showing part of a supply head or supply-suction head usable for a further modification of the apparatus shown in FIG. 1 or FIG. 9.

The supply head 10 and supply-suction head 20 may be made of metal, ceramic, plastic etc. The supply port of the supply head 10 or supply-suction head may be in the form of a nozzle, a chute as shown in FIG. 22 or of the type capable of downwardly supplying the materials directly from the gate of the supply vessel, etc. The suction port of the supply-suction head may be in the form of a nozzle, a slit, etc. The gates of the supply head or supply-suction head may be of a type operated by the hand, electricity, air pressure, oil pressure, etc.

Any one or combination of the supply heads or supply-suction heads is selected in accordance with a pattern to be formed. The materials can be supplied from the vessel for particles to the supply head 10 or supply-suction head 20 either directly or through a pipe into which the materials are allowed to spontaneously drop or through a feed device utilizing air, a screw, etc. In addition to the articulated coordinate robot 17 shown in FIG. 17, any other industrial robot can be used in association with the apparatus. The apparatus may be of a multi-head type or a composite type as shown in FIG. 4. In any of the apparatus described above, a vibrator, antistatic device, and/or various auxiliaries can be additionally used when necessary.

The methods for producing patterned shaped articles using the apparatus mentioned above will now be described hereinafter.

Figure 23:
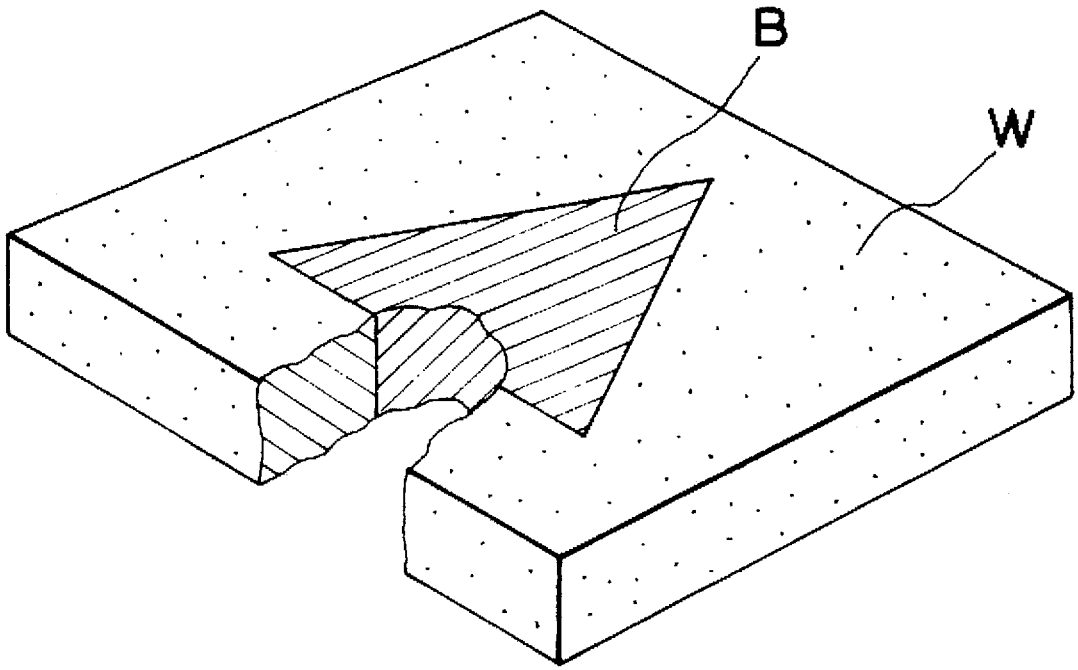
FIG. 23 is a perspective view showing a patterned shaped article obtained by a method using the apparatus according to this invention.
Figure 24:
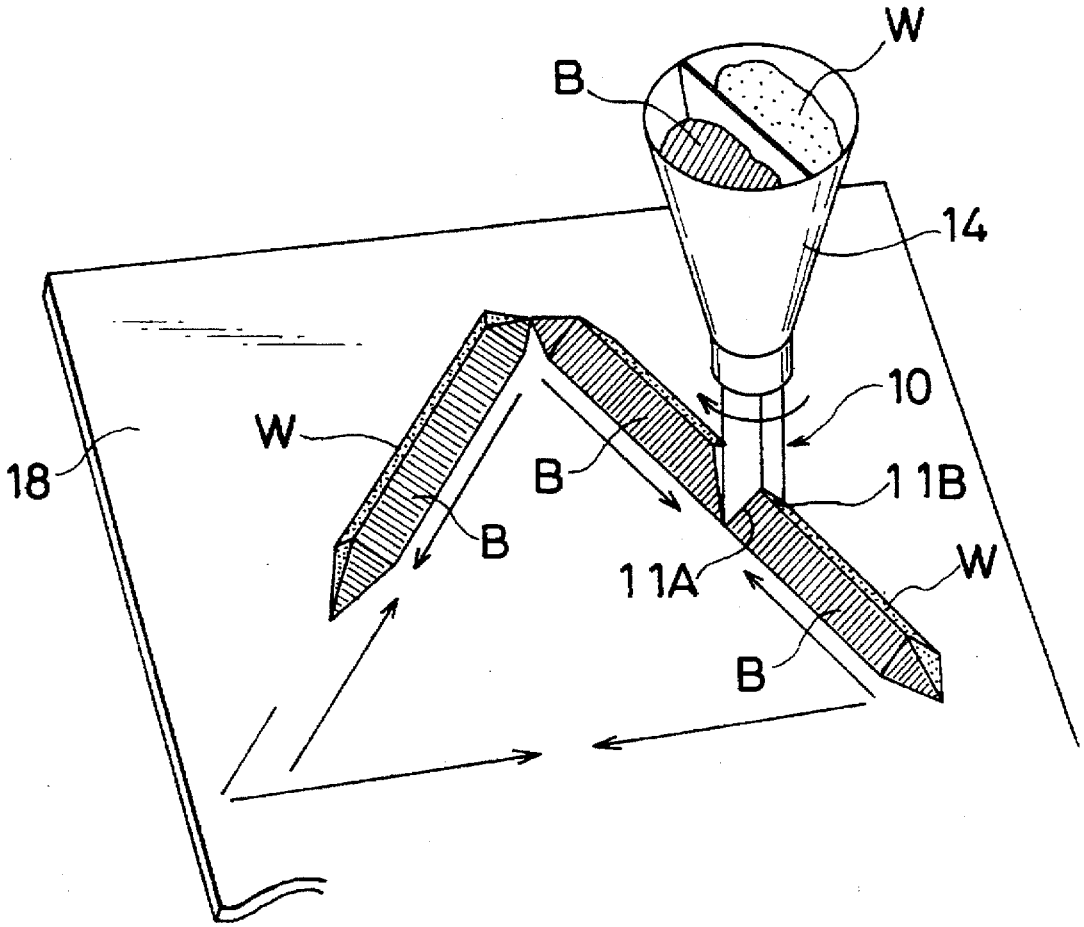
FIG. 24 is an explanatory perspective view showing a method for producing the patterned shaped article shown in FIG. 23, using the first embodiment of the apparatus.

The patterned shaped article shown in FIG. 23 can be produced using the apparatus shown in FIG. 1 by placing the supply head 10 of FIG. 2 having the triangular supply ports 11A and 11B at a position corresponding to one apex of a triangle to be formed on a given surface 18, moving the supply head 10 to a position corresponding to one half of a side of the triangle while supplying a blue material B from the supply port 11A and a white material W from the supply port 11B, closing the gates 13 and moving the supply head 10 to a position corresponding to another apex of the triangle on an extension of the formed one-half side of the triangle, turning the supply head 10 by 180°, opening the gates 13 and, while supplying the white material W from the supply port 11A and the blue material B from the supply port 11B, moving the supply head 10 to the formed one-half side of the triangle to form one side of the triangle having sharp opposite ends as shown in FIG. 24, repeating these steps to form two remaining sides of the triangle, then closing the supply port 11B with the gate 13 and supplying the blue material B from the supply port 11A onto the portion of the given surface 18 surrounded by the three sides of the triangle, thereafter closing the supply port 11A with the gate 13 while opening the supply port 11B and supplying the white material W from the supply port 11B onto the portion of the given surface 18 outside the three sides of the triangle, placing a backing layer (not shown) on the supplied materials when necessary, and allowing the supplied materials into an integral mass with or without the backing layer. A gap formed by the partition member 12 shown in FIG. 2 is completely buried by the materials during the advance of the supply head 10 owing to their cave-in action.

Figure 25:
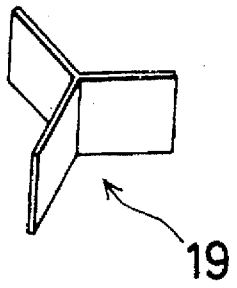
FIG. 25 is a perspective view showing an end stopper usable for the method shown in FIG. 24.
Figure 26:
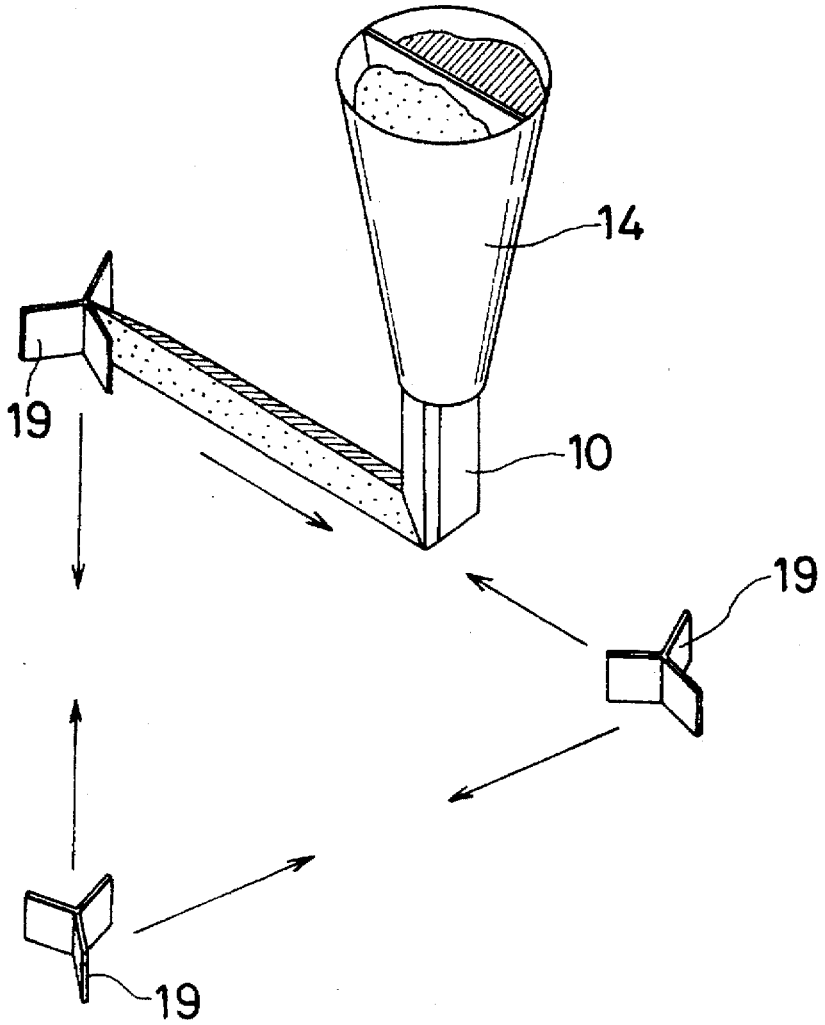
FIG. 26 is an explanatory perspective view showing the method of FIG. 24 using the end stopper pieces of FIG. 25.

In order to form clear-cut apexes of the triangle, end stopper pieces 19 as shown in FIG. 25 are used. To be specific, the end stopper pieces 19 are placed at positions corresponding the three apexes of a triangle as shown in FIG. 26, then the same steps as described above with reference to FIGS. 23 and 24 are taken and thereafter the three end stopper pieces 19 are removed. The end stopper piece 19 is shaped in accordance with a pattern to be formed. Examples of the end stopper piece 19 are as shown in FIGS. 30, 32, 33 and 34. When the end stopper piece 19 is made of a material soluble in water, oil, a solvent, etc., it is unnecessary to remove. In FIG. 26, the end stopper pieces 19 are merely placed on the given surface (not shown). However, they may be temporarily fixed to the given surface 18 by means of magnetism or adhesive.

Figure 27:
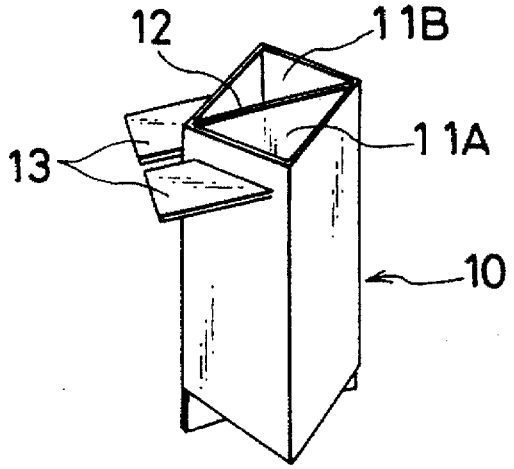
FIG. 27 is a perspective view showing a supply head different from that shown in FIG. 24.
Figure 28:
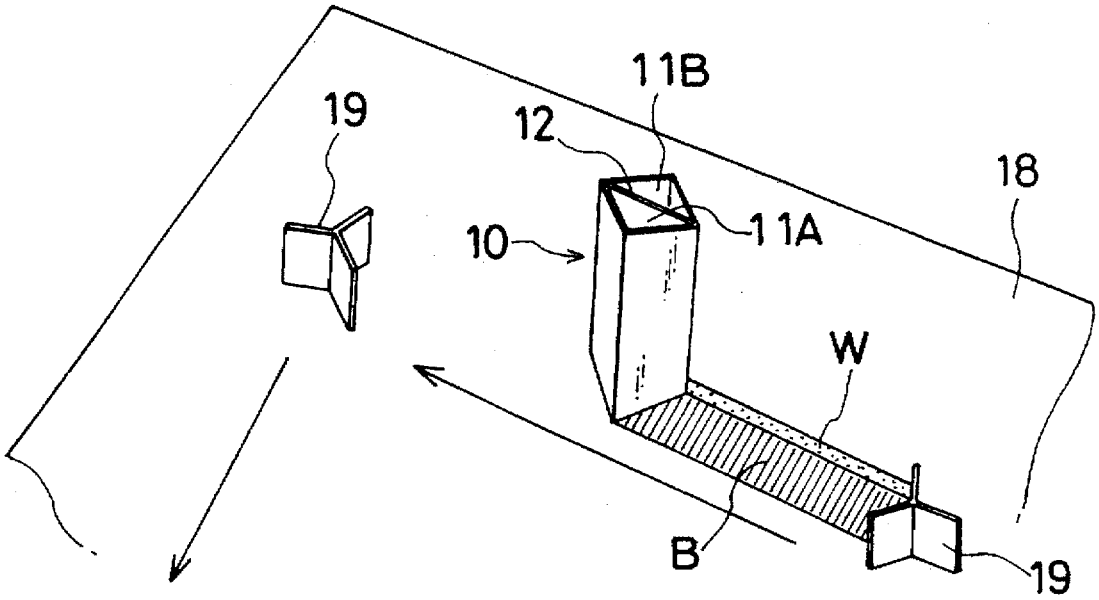
FIG. 28 is an explanatory perspective view showing the method of FIG. 24, using the end stopper pieces of FIG. 25 and the supply head of FIG. 27.

The patterned shaped article shown in FIG. 23 can also be produced by various methods using different supply heads other than the methods shown in FIGS. 24 and 25. For example, when the blue and white materials are supplied onto a given surface to form three sides of a triangle by the use of a supply head 10 of FIG. 27 having a rhombic sectional profile divided with a diagonally extending partition member into two triangles serving as supply ports 11A and 11B, since the opposite ends of each side of a triangular pattern to be formed become sharp as shown in FIG. 28, each side of the triangular pattern can be formed continuously without requiring 180° rotation of the supply head 10 as in the method of FIG. 24.

Figure 29:
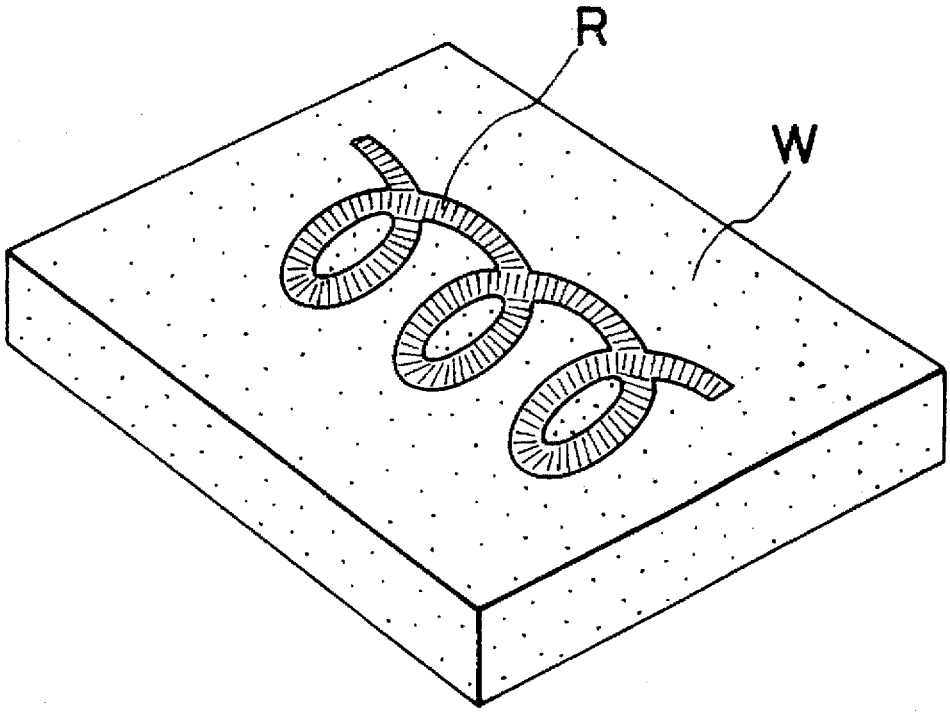
FIG. 29 is a perspective view showing another patterned shaped article obtained by a method using the apparatus according to this invention.
Figure 30:
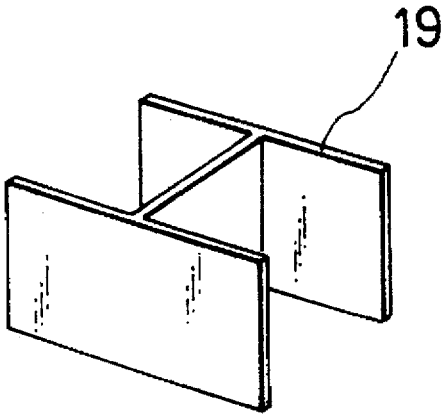
FIG. 30 is a perspective view showing another end stopper piece usable for obtaining the patterned shaped article of FIG. 29.

The patterned shaped article shown in FIG. 29 is produced, using the apparatus of FIG. 3, by disposing H-shaped end stopper pieces 19 shown in FIG. 30 in advance at a starting point, a terminal point and a plurality of intersecting points on a given surface, applying the supply head 10 shown in FIG. 5 to the end stopper piece 19 at the starting point, moving the supply head 10 to a point becoming a first intersecting point while supplying onto a given surface a red material R from the supply port 11A and a white material W from both the supply ports 11B and 11B', lifting the supply head 10 to the upper end of an end stopper piece 19 disposed at the first intersecting point, with the supply port 11A left open and the supply ports 11B and 11B' closed, to supply the red material R alone to the inside of the end stopper piece 19, lowering the supply head 10 and opening the supply ports 11B and 11B' as soon as the supplied head 10 passes through the end stopper piece 19, thereby supplying the red and white materials R and W again on the given surface while describing a loop, closing all the supply ports 11A, 11B and 11B' with the gates 13 at the first intersecting point and lifting the supply head 10 to the upper end of the end stopper piece 19 until the supply head 10 pass through the first intersecting point, lowering the supply head 10 to its original position and opening the gates 13 to continue supply of the materials from the supply ports 11A, 11B and 11B', repeating these steps until the supply head 10 reaches the terminal point to form a pattern comprising a plurality of loops, supplying white material W inside and outside the loops, placing a backing layer on the supplied materials when necessary, and allowing the materials into an integral mass with or without the backing layer. Gaps formed by the partition members 12 are completely buried by the materials during the advance of the supply head 10 owing to their cave-in action. Gaps formed by removal of the end stopper pieces 19 are also buried completely by the cave-in action of the materials.

Figure 31:
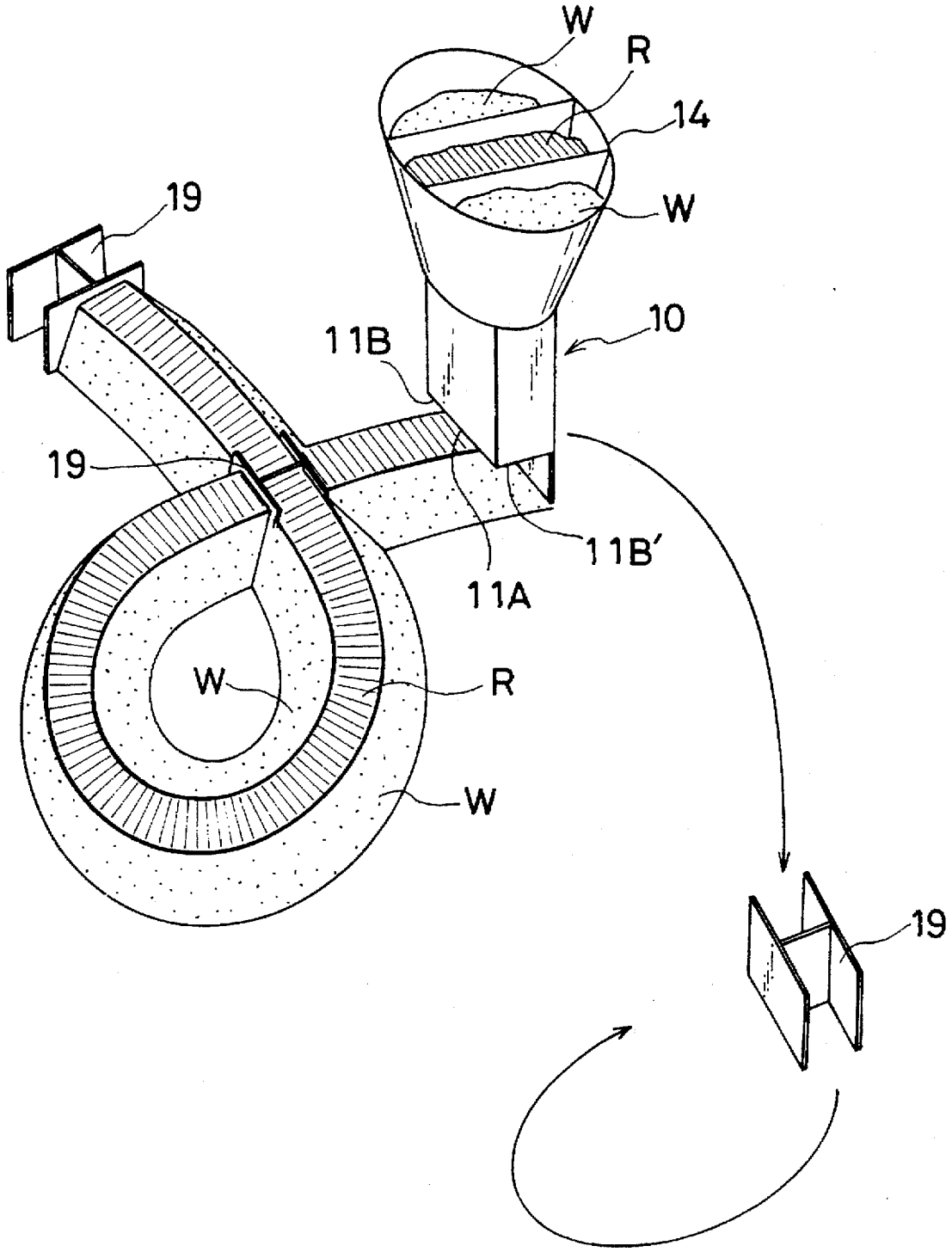
FIG. 31 is an explanatory perspective view showing the method for producing the patterned shaped article of FIG. 29, using the end stopper pieces of FIG. 30.
Figure 32:
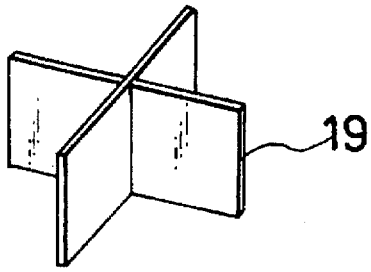
FIG. 32 is a perspective view showing another example of end stopper piece usable for this invention.
Figure 33:
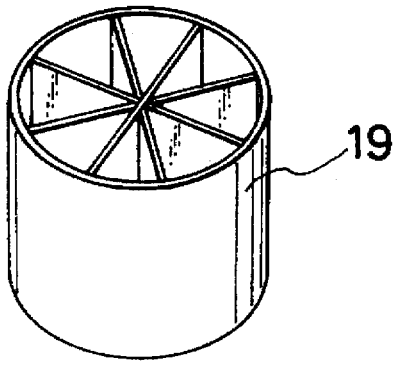
FIG. 33 is a perspective view showing still another example of end stopper piece usable for this invention.
Figure 34:
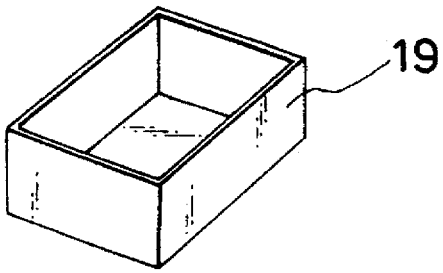
FIG. 34 is a perspective view showing yet another example of end stopper piece usable for this invention.

The patterned shaped article shown in FIG. 29 can also be produced by various methods using different supply heads other than the method shown in FIG. 31, which will be described later.

Figure 35:
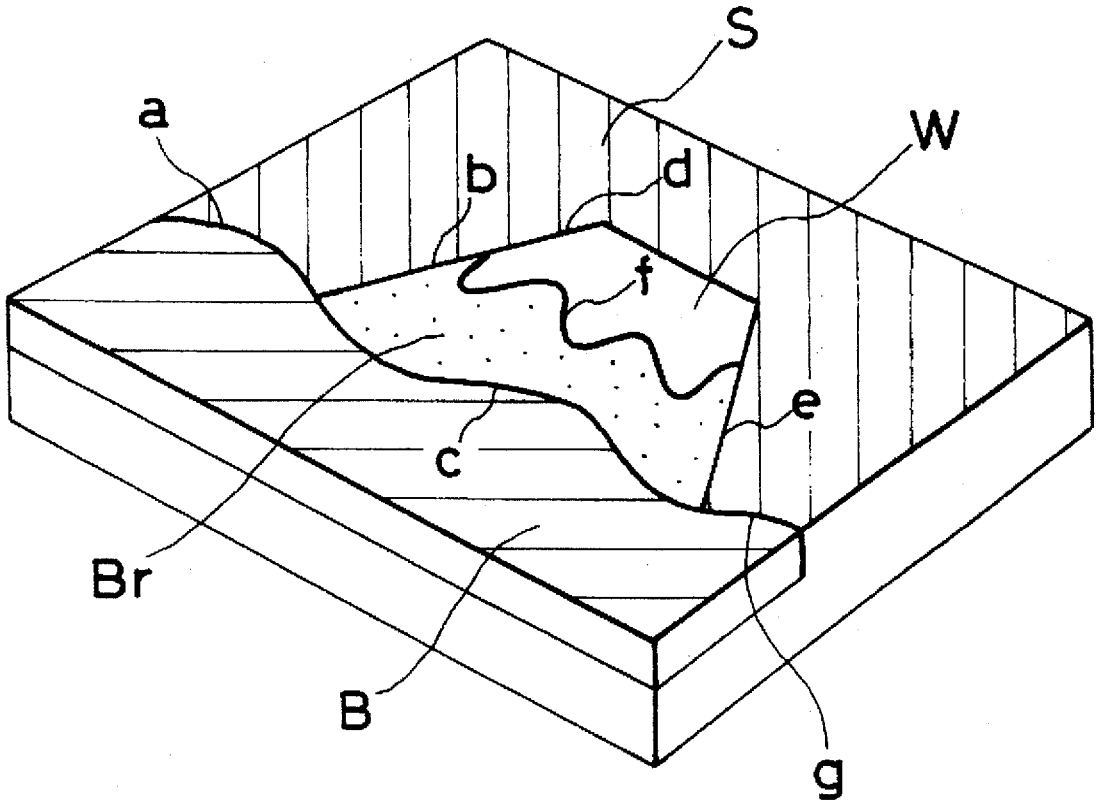
FIG. 35 is a perspective view showing still another patterned shaped article obtained by a method using the apparatus according to this invention.

The patterned shaped article shown in FIG. 35 is produced using the apparatus of FIG. 1. First, the boundaries between the shapes of a pattern to be formed are formed by moving the supply head 10 of FIG. 2 having the supply ports 11A and 11B of a triangular sectional profile while simultaneously supplying a sky-blue material S for representing the sky and a blue material B for representing the sea to form the boundary a between the sky and the sea, the material S and a brown material Br for representing the side of a mountain to form the boundary b between the sky and the mountain side, the materials Br and B to form the boundary c between the mountain side and the sea, the material S and a white material W for representing the snow covered peak of the mountain to form the boundary d between the sky and the mountain peak, the materials S and Br to form the boundary e between the sky and the mountain side, the materials W and Br to form the boundary f between the mountain peak and the mountain side, and the materials S and B to form the boundary g between the sky and the sea, respectively. The switchover of the materials to be simultaneously supplied can be attained by 180° rotation of the supply head, replacement of the materials and use of a plurality of such apparatus each having a supply head. When using a plurality of apparatus, it is unnecessary to rotate the supply heads by 180°. Upon completion of the formation of all the boundaries, the sky portion, mountain peak portion, mountain side portion and sea portion are filled respectively with the materials S, W, Br and B each supplied from one of the supply ports 11A and 11B of the supply head 10. All the supplied materials are caused to set after a backing layer has been formed thereon when necessary. The gap formed by the partition member 12 of the supply head 10 is completely buried by the materials during the advance of the supply head 10 owing to their cave-in action. In the formation of the patterned shaped article shown in FIG. 35, the boundaries among the mountain side, sea and sky and those among the mountain side, mountain peak and sky can be made clear-cut by selectively placing the end stopper pieces 19 shown in FIGS. 30 and 32–34 at the boundaries, applying the supply head 10 to one of the end stopper pieces 19, continuing the supply and movement of the supply head 10 and removing the end stopper pieces 19 upon completion of the supply of the materials. In this case, when the end stopper pieces 19 are made of a soluble material, they are unnecessary to remove. The end stopper pieces 19 may either be merely placed on or be temporarily fixed to their respective appropriate positions. The temporary fixation can be attained with ease by means of magnetism or adhesive. The patterned shaped article shown in FIG. 35 can also be produced by other methods optionally using different supply heads than the method just mentioned, which will be described later.

The patterned shaped article shown in FIG. 23 can also be produced using the apparatus of FIG. 11 having the supply-suction head 20 of a circular sectional profile shown in FIG. 12. This will be explained with reference to FIGS. 36(A) to 38(B).

Figure 36A:
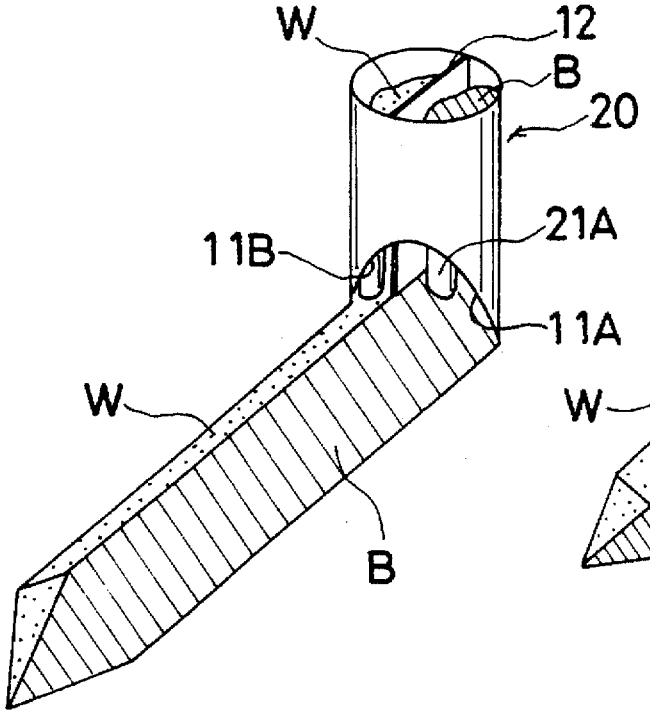
FIG. 36(A) is an explanatory perspective view showing a state in which particles are supplied from an apparatus for simultaneously supplying particles and provided further with a function to remove the particles by suction, thereby forming a linear pattern.
Figure 36B:
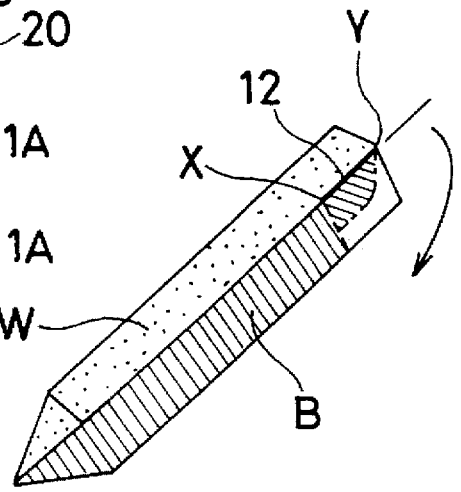
FIG. 36(B) is a perspective view showing a state in which the linear pattern of FIG. 36(A) has been partially removed by suction.
Figure 37A:
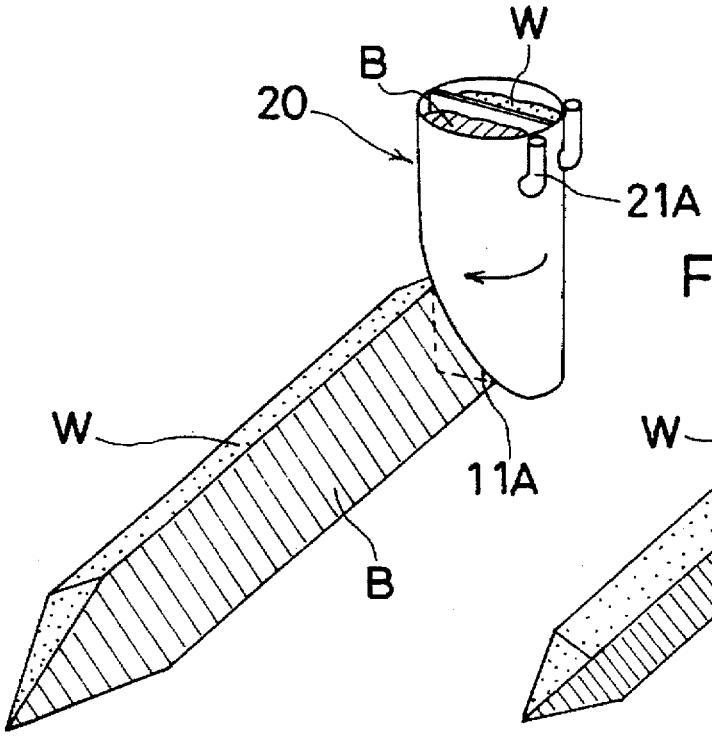
FIG. 37(A) is an explanatory perspective view showing a state in which particles are supplied from an apparatus for simultaneously supplying particles and provided further with a function to remove the particles by suction, thereby forming a linear pattern.
Figure 37B:
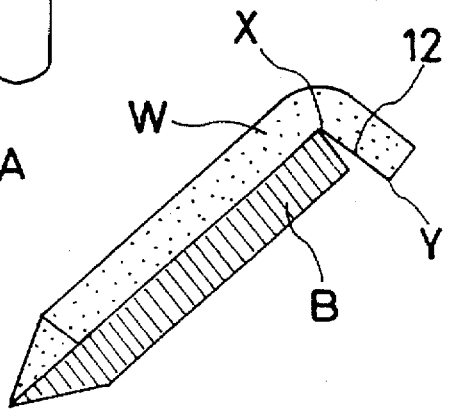
FIG. 37(B) is an explanatory view showing a state in which the linear pattern of FIG. 37(A) has been partially removed by suction.
Figure 38A:
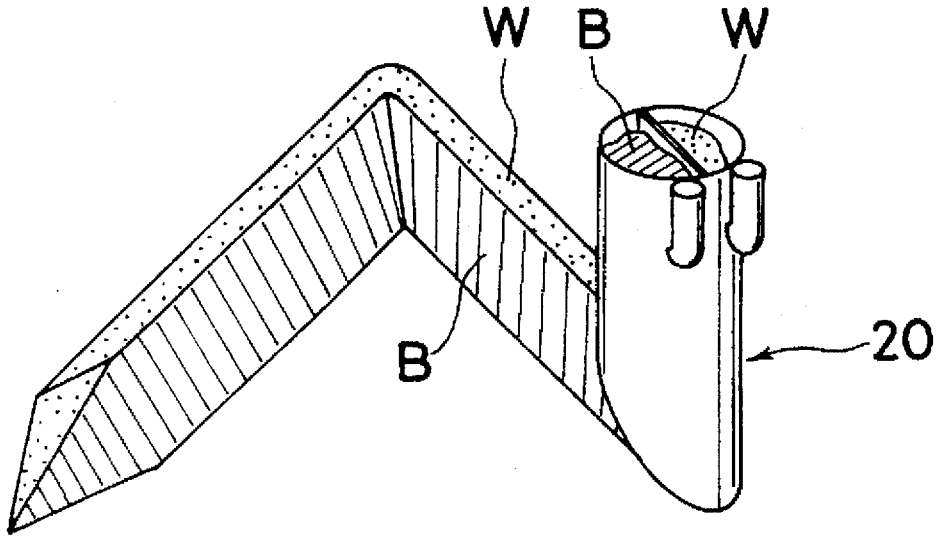
FIG. 38(A) is an explanatory perspective view showing a state in which particles are supplied from an apparatus for simultaneously supplying particles and provided further with a function to remove the particles by suction, thereby forming a linear pattern.
Figure 38B:
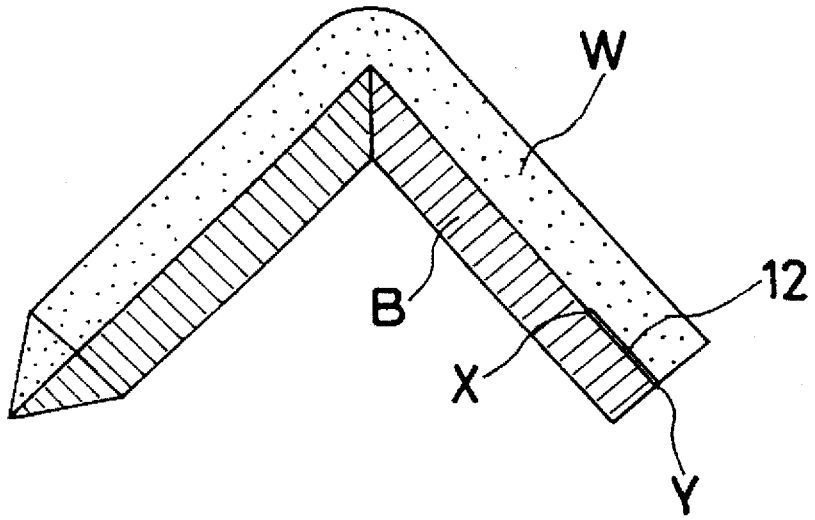
FIG. 38(B) is an explanatory view showing advancement of the linear pattern of FIG. 38(A).

As shown in FIG. 36(A), a blue material B and a white material W are simultaneously supplied respectively from the supply ports 11A and 11B of the supply-suction head 20 while moving the supply-suction head 20 until one end edge X of the partition member 12 reaches one of the apexes of a triangle, thereby forming one side of a triangle. At this time, the supply of the white material W from the supply port 11B continues while the supply of the blue material B from the supply port 11A is temporarily stopped and, as shown in FIGS. 36(B) and 37(A), the supply-suction head 20 is turned, with the one end edge X of the partition member 12 as the center, while sucking up part of the supplied blue material from the suction port 21A. As shown in FIG. 37(B), when the opposite end edge Y of the partition member 12 has been located on another side of the triangle, the suction from the suction port 21A is stopped and the supply of the blue material B from the supply port 11A is started again under the continuation of the supply of the white material W from the supply port 11B while moving the supply-suction head 20, thereby forming another side of the triangle as shown in FIG. 38(A) and FIG. 38(B). The remaining one side of the triangle is formed in the same manner as described above. The gap being formed by the partition member 12 during the movement of the supply-suction head 20 is completely buried by the cave-in action of the supplied materials. Upon forming the three sides of the triangle, the supply of the white material W from the supply port 11B is stopped and the blue material B is supplied to the inside of the triangle from the supply port 11A. Subsequently, the supply of the blue material B from the supply port 11A is stopped and the white material W is supplied to the outside of the triangle. All the supplied materials are caused to set after a backing layer has been formed when necessary. Methods for producing the patterned shaped article shown in FIG. 23 are not restricted to those described hereinbefore and another embodiment will be described later.

The patterned shaped article shown in FIG. 29 can also be produced using the apparatus of FIG. 9 having the supply-suction head 20 shown in FIG. 10.

The supply-suction head 20 is disposed at a starting point and, while simultaneously supplying a red material R and a white material W respectively from the supply ports 11A and 11B, is moved to a terminal point, provided that when the materials being supplied intersect the already supplied materials, the supply of the white material W from the supply port 11B is stopped and, while part of the supplied white material W is sucked up from the suction port 21A, the red material R is supplied from the supply port 11A to form a red intersection and thereafter the supply of the white material W from the supply port 11B is started again. With the advance of the supply-suction head 20, the gap being formed by the partition member 12 is buried by the cave-in action of the materials R and W. Upon completion of the formation of the pattern, the materials are caused to set after a backing layer has been deposited thereon when necessary. Methods for producing the patterned shaped article shown in FIG. 29 are not restricted to those described hereinbefore and another embodiment will be described later.

The patterned shaped article shown in FIG. 35 can also be produced using the apparatus of FIG. 11. First, the boundaries between the shapes of a pattern to be formed are formed by moving the supply-suction head 20 of FIG. 12 having the supply ports 11A and 11B of a semicircular sectional profile while simultaneously supplying a sky-blue material S for representing the sky and a blue material B for representing the sea to form the boundary a between the sky and the sea, the material S and a brown material Br for representing the side of a mountain to form the boundary b between the sky and the mountain side, the materials Br and B to form the boundary c between the mountain side and the sea, the material S and a white material W for representing the snow covered peak of the mountain to form the boundary d between the sky and the mountain peak, the materials S and Br to form the boundary e between the sky and the mountain side, the materials W and Br to form the boundary f between the mountain peak and the mountain side, and the materials S and B to form the boundary g between the sky and the sea, respectively. The switchover of the materials to be simultaneously supplied can be attained by replacement of the vessels 14. Upon completion of the formation of all the boundaries, the sky portion, mountain peak portion, mountain side portion and sea portion are filled respectively with the materials S, W, Br and B each supplied from one of the supply ports 11A and 11B of the supply-suction head 20. All the supplied materials are caused to set after a backing layer has been formed thereon when necessary. The gap formed by the partition member 12 of the supply-suction head 20 is completely buried by the materials during the advance of the supply-suction head 20 owing to their cave-in action. In the formation of the patterned shaped article shown in FIG. 35, the boundaries among the mountain side, sea and sky and those among the mountain side, mountain peak and sky can be made clear-cut by selectively placing the end stopper pieces 19 shown in FIGS. 30 and 32–34 at the boundaries, applying the supply-suction head 20 to one of the end stopper pieces 19, continuing the supply and movement of the supply-suction head 20 and removing the end stopper pieces upon completion of the supply of the materials. In this case, when the end stopper pieces 19 are made of a soluble material, they are unnecessary to remove. The end stopper pieces 19 may either be merely placed on or be temporarily fixed to their respective appropriate positions. The temporary fixation can be attained with ease by means of magnetism or adhesive. Methods for producing the patterned shaped article shown in FIG. 35 are not restricted to the method just mentioned, and another embodiment will be described later.

The patterned shaped article shown in FIG. 23 can also be produced using the apparatus of FIG. 15 having the supply-suction head 20 shown in FIG. 16. A white material W is supplied onto a given surface from the supply port 11 of the supply-suction head 20 to form a white layer thereon. The supply-suction head 20, with the enclosure member 15 retained at a lower position, is inserted into the white layer at a position corresponding to one of the apexes of a triangle to suck up the white material W around the apex from the suction port 21. Immediately after the suction, a blue material B is supplied from the supply port 11 to form a blue apex. While the enclosure member 15 is slid upward for sucking the white material W and supplying the blue material B, the supply-suction head 20 is moved to a position corresponding to one half a side of the triangle. The steps mentioned above are repeated six times to produce three apexes and three sides of the triangle. The portion of the triangle surrounded by the three apexes and three sides is filled with the blue material B supplied from the supply port 11. Also in this case, the gap being formed by the supply-suction head 20 is buried by the materials during the advance of the supply-suction head 20 owing to their cave-in action. The supplied materials are caused to set after a backing layer has been deposited thereon, when necessary.

Figure 39:
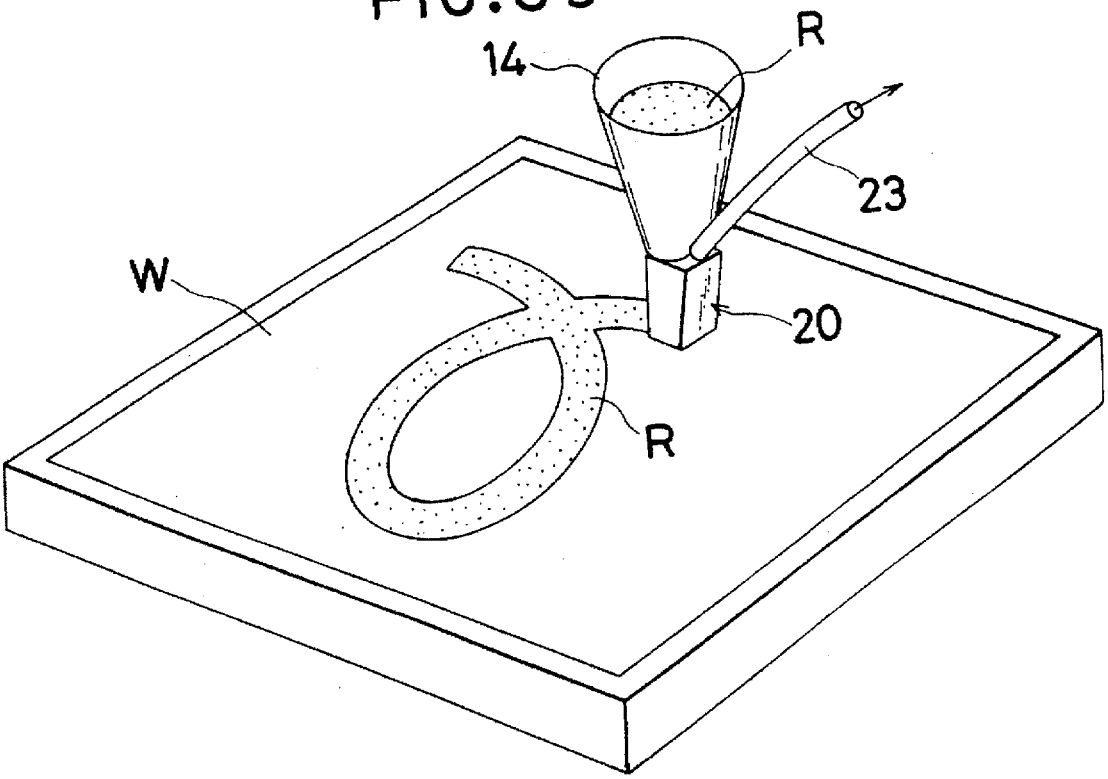
FIG. 39 is a perspective view showing a state in which particles are supplied to form a linear pattern.

The patterned shaped article shown in FIG. 29 can also be produced using the apparatus of FIG. 13 provided with the supply-suction head 20 of FIG. 14 having the supply port 11 of a rectangular sectional profile. A white material W is supplied to form a white layer on the table 30. The supply-suction head 20 is then inserted into the white layer at a starting point and, as shown in FIG. 39, the white material W of the formed white layer is sucked up from the suction port 11 and immediately thereafter a red material R is supplied from the supply port 11. When the red material R being supplied intersect the red material R already supplied, since the already supplied red material R is also sucked up, the intersection is beautifully formed. With the advance of the supply-suction head 20, the gap being formed by the supply-suction head 20 is buried by the red material R owing to its cave-in action. All the supplied materials are caused to set into an integral mass after a backing layer has been formed thereon, if necessary. The supply-suction head 20 shown in FIG. 10 may be used instead.

The patterned shaped article shown in FIG. 35 can also be produced using the apparatus shown in FIG. 15 provided with the supply-suction head 20 of FIG. 16 having a pair of supply port 11 and suction port 21. As shown in FIG. 15, a white material W for representing the snow covered peak of a mountain is first supplied to form a white layer on the table 33, for example. In this case, the supply-suction head 20 is moved to supply a sky-blue material S for representing the sky from the supply port 11 while sucking up the supplied white material W from the suction port 21 to form the sky portion. Similarly, a brown material Br representing the side of the mountain is supplied while sucking up the supplied white material W to form the mountain side portion, and a blue material B for representing the sea is supplied while sucking up the supplied white material W to form the sea portion. The boundaries among the white, sky, mountain peak, mountain side and sea portions can be made clear-cut by sucking up a material, with the enclosure member 15 moved downward, and then supplying a corresponding material. With the advance of the supply-suction head 20, the gap being formed by the partition member 12 is buried by the materials owing to their cave-in action. Upon completion of the formation of the pattern, all the materials are set into an integral mass after a backing layer has been formed thereon when necessary. Since the white material W is used as the base material, in this case, it is possible to obtain a patterned shaped article by coloring or supplying the sucked white material with a coloring material including a pigment, colorant, and particles of metal, ore, rock, ceramic, etc. and supplying the resultant materials to the respective portions deprived of the white material for forming the sky, mountain side and sea. By doing so, it is possible to afford a subtle continuous change in color to the pattern and it suffices if the coloring material alone is prepared in the apparatus. Coloring should be effected from a light color to a dark color in the same manner as in dyeing. A supply-suction head having the supply-suction head 20 of FIG. 12 provided further with a vertically slidable suction port may be used instead.

Figure 40:
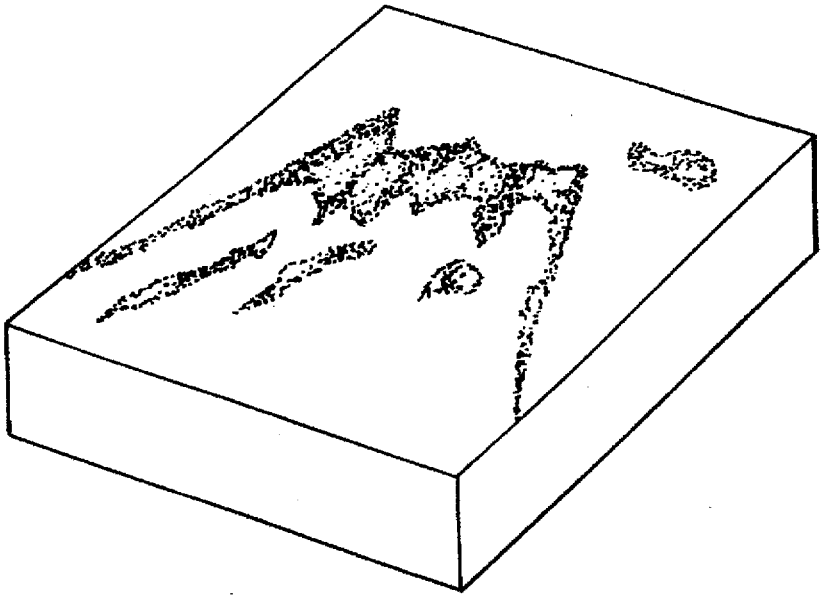
FIG. 40 is an explanatory view showing a shaped article having a pattern like the image of a photograph, obtained by repeating supply and suction of particles in the form of dots.

In any of the methods described above, it is optional how a pattern is formed using which of the apparatus shown in the accompanying drawings. Various patterned shaped articles can be produced by a combination of any one of the methods and any one of the apparatus so far described. For example, a dotted pattern can be realized, using a supply-suction head having an auxiliary member 15 consisting of a plurality of parallel plates and a plurality of supply and suction port pairs each provided between the adjacent parallel plates, by inserting the plates into a layer of material formed on a given surface and, while moving the supply-suction head in parallel to the plates, repeating supply and suction of materials. That is to say, a pattern like the image of an photograph as shown in FIG. 40 can be produced with ease. Such a dotted (discontinuous) pattern can also be produced by using any one of the apparatus shown in the accompanying drawings.

In any one of the methods, the amount of the materials to be supplied and sucked up is regulated at the time of supply and suction to form a clear-cut pattern. Use of auxiliary members such as the end stopper pieces 19 at the initial, terminal, temporarily terminal and intersecting points makes a pattern more clear-cut. The end stopper pieces 19 are not limited to those shown in the accompanying drawings and may be of any other shape. Use of soluble end stopper pieces eliminates removal thereof. The end stopper pieces may either be merely placed on or be temporarily fixed to a given surface. The temporary fixation preferably relies not only on magnetism or adhesive property but also on any other fixing means. The height of the end stopper pieces is determined depending on the thickness of a pattern to be formed. When the table 33 is made of rubber, sponge, paper, non-woven fabric, woven fabric, knit fabric, or like material, application of the partition member 12 of the supply head 10 or supply-suction head 20 or application of the auxiliary member 15 such as the enclosure member onto the surface (given surface) of the table 33 forms a space between the given surface and the supply or supply-suction head, thereby facilitating the positioning of the head in its height direction. The materials are completely separated by the partition member, a clear-cut linear pattern can be obtained. In addition, the supply or supply-suction head is applied to the given surface utilizing a resilient member such as a spring etc. or an elastic member such as rubber etc., or otherwise the surface of the partition member being abutted against the given surface may be provided with a thread or string-like elastic member.

In supplying and sucking up the materials, the partition member 12 and auxiliary member 15 such as the enclosure member may either be abutted against or be slightly separated from the given surface and the positions of the supply and suction ports 11 and 21 may either come into contact with or be apart from the given surface insofar as the supply head and supply-suction head can be actuated.

Although the material is dry, it may have absorbed some moisture if it is not kneaded with water, oil, lubricant-bonding agent, solvent, setting agent or plasticizer and is in a state readily amenable to pulverization before supplying. On the other hand, the material of which the backing layer is formed may be either dry or wet with one or more of water, oil, lubricant-bonding agent, solvent, setting agent and plasticizer. Otherwise, a plate of metal, wood, cement, glass or ceramic or a sheet of paper, unwoven fabric, woven fabric, knit fabric or plastic may be used as the backing layer. In this case, the plate or sheet serves as the given surface. Any other existing shaped article may be used as the given surface.

The materials to be supplied may differ from one another depending on the shaped article to be produced. Otherwise, in the finished state they are required to differ from one another in color, luster, texture and the like.

In producing a concrete shaped article, the pattern-course material is dry and is cement powder, resin or a mixture thereof and may additionally include at least one of a pigment and fine aggregates. Examples of the material for a backing layer include cement powder, resin, a mixture of cement powder and resin, the mixture further containing a fine aggregate and, if necessary, additionally containing a pigment and at least one of coarse aggregates and various kinds of fibers. The backing material may either be the same material as the pattern-course material or be in the form a concrete slurry obtained by kneading with water etc.

Both the materials for the pattern course and the material for the backing layer may additionally include wood chips as aggregates or fine aggregates and may further include as blended therewith crushed or pulverized granite, crushed or pulverized marble, slag, light-reflecting particles, inorganic hollow bodies such as Shirasu balloons, particles of ceramics, new ceramics, metal, ore or other such substances. They may also contain as additives a congealing and curing promoter, a waterproofing agent, an inflating agent and the like. The aforementioned various kinds of usable fibers include metal fibers, carbon fibers, synthetic fibers, glass fibers and the like.

All the materials are supplied into a frame etc. and are allowed to set into an integral mass. Otherwise, after the material supplying, water is supplied in a suitable amount to all portions of the interior of the frame etc., thereby setting the materials into an integral mass within the frame etc. If a wet material is used for the backing layer, the amount of water supplied is reduced in view of the water contained in the wet material. When a plate of metal, wood, cement, glass or ceramic or a sheet of paper, unwoven fabric, woven fabric or knit fabric is used as the backing layer, for example, it is set integral with the pattern course. An asphaltic concrete shaped article can be produced using a thermal fusion material such as asphalt etc.

In producing an artificial stone shaped article, the materials for the pattern course and the material for the backing layer may, for example, be constituted of one or more of rock particles, ceramic particles, new ceramic particles, glass particles, plastic particles, wood chips or metal particles and may, as found necessary, further have mixed therewith a pigment and a setting agent for bonding the mixture. The setting agent is a mixture of cement powder and water, a mixture of cement powder, resin and water, or a mixture of resin, water and a solvent and may further contain particles of one or more of rock, ceramic, new ceramic, glass and plastic and may, as found necessary, be kneaded with a pigment or colorant and have mixed therewith various kinds of particles, various kinds of fibers, various kinds of mixing agents and various kinds of additives. The various kinds of particles include particles of slag, fly ash and light-reflecting substances. The various kinds of fibers include metal fibers, carbon fibers, synthetic fibers and glass fibers. The various kinds of mixing agents and additives include shrink proofing agents, congealing and setting agents, delaying agents, waterproofing agents, inflating agents, water reducing agents, fluidizing agents and the like.

If necessary for enhancing the adherence of the setting material with the aforementioned materials, the materials can be sprayed with or immersed in water, solvent or surface treatment agent. However, they are not kneaded with such moisture and are in a state readily amenable to pulverization.

All the materials can be set into an integral mass within a frame etc. by vacuum-suction treatment, or other such treatment, for spreading the setting agent between adjacent particles or by using a mixture of aggregates and a setting agent as the material for the backing layer. When a plate of metal, wood, cement, glass or ceramic or a sheet of paper, unwoven fabric, knit fabric, woven fabric or plastic is used as the backing layer, the pattern course is attached as superposed on the backing layer.

For producing a ceramic shaped article or the raw product for a ceramic shaped article, the dry materials for the pattern course are particles of one or more of clay, rock, glass, new ceramic, fine ceramic and glaze with or without a pigment or colorant added thereto. The materials may be ones which have absorbed some water or been added with a lubricant-bonding agent after drying but they are not kneaded with the lubricant-bonding agent or water and are in a state readily amenable to pulverization. The material for the backing layer is constituted of particles of one or more of clay, rock, glass, new ceramic and fine ceramic and may additionally contain a pigment and a colorant. In the finished state, the backing layer is required to differ from the pattern course in color, luster, texture and the like and may be either dry, similarly to the pattern course, or made wet by kneading with water or a lubricant-bonding agent. In addition, either the materials for the pattern course or the material for the backing layer may have further mixed therewith inorganic hollow bodies such as Shirasu balloons, and particles of ceramic, metal or ore and may have added thereto various kinds of foaming agents, fluidization-preventing agents, supernatant agents, lubricating agents, bonding agents and adherence promoters as additives.

The materials supplied into a frame etc. are allowed or caused to set into an integral mass without adding, or by adding, a predetermined amount of water or lubricant-bonding agent to plasticize them and applying pressure to the resultant mixture. The set integral mass is removed from the frame etc. and used as a raw product. The raw product is sintered to obtain a ceramic shaped article. Otherwise, the materials supplied into a refractory setter or the like frame are melted or fused by heating to obtain an integral mass, and the integral mass is removed from the setter. In the case of a shaped article of enamel, stained glass or crystalline glass the material for the pattern course is laid on a plate of metal, glass or ceramic and melted or fused by heating to be made integral with the plate.

The dry materials for the pattern course used in producing a shaped article having an impasto layer are various kinds of powdered paint, and the material for the backing layer is a plate or the like of metal, wood, cement or ceramic. The various kinds of powdered paint include acrylic resin, polyester resin, acrylic-polyester hybrid resin, fluorine resin and similar resins having a pigment or colorant added thereto. The materials for the pattern course are laid on the plate as a backing layer and melted and fused by heating to unite the two layers together. In uniting the two layers together, pressure may be applied to the layers. As a result, it is possible to obtain a plate having an impasto layer thereon.

The dry materials for producing a raw product for a patterned shaped metal article are particles of one or more of various metals and alloys with or without a lubricant added thereto. The materials may be ones which have been added with a lubricant after drying but they are not kneaded with the lubricant and are in a state readily amenable to pulverization. The materials for a backing layer are particles of one or more of various metals and alloys with or without a lubraicant added thereto and may either be dry or made wet by kneading with a lubricant. Examples of the lubricant used include zinc stearate etc. In addition, either the dry materials or the materials for the backing layer may have further mixed therewith a binder and other additives. The materials supplied into a frame etc. are exposed to pressure to set into an integral mass. The set integral mass is removed from the frame etc. and used as a raw product. The raw product is sintered to obtain a patterned shaped metal article. Otherwise, the materials are supplied onto a plate of metal, glass, ceramic, etc. and pressure is applied to the materials and plate to obtain an integral mass. The integral mass is then sintered.

In producing a plastic shaped article, the dry materials for the pattern course are constituted of particles of various kinds of plastics and may additionally contain a pigment or colorant. The materials may also contain a plasticizer or solvent, but are not kneaded with a plasticizer or solvent and are in a state readily amenable to pulverization. The material for the backing layer may be either dry or made wet by kneading with a plasticizer or solvent. The various kinds of plastics include polyethylene, nylon, polypropylene, polycarbonate, acetal, polystyrene, epoxy, vinyl chloride, natural rubber, synthetic rubber, acrylonitrile-butadiene-styrene, polypropylene oxide, ethylene-vinyl acetate copolymer, fluorine resin and other thermoplastic and thermosetting resins. Both the materials for the pattern course and the material for the backing layer may, as found necessary, contain a foaming agent, oxidization preventing agent, thermal stabilizer, bridging agent, other additives and particles of inorganic materials. All the materials are melted or fused into an integral mass by heating, while applying pressure thereto, if necessary. With this method, it is possible to produce a patterned shaped article of foamed styrol, patterned shaped bathtub or floor tile of plastic, etc. In this case, the two layers may be united with a plate of metal, wood, cement, ceramic or a sheet of paper, unwoven fabric, knit fabric, woven fabric or plastic.

In producing confectionery or other shaped foodstuffs, the dry materials for the pattern couruse are constituted of particles of one or more of wheat, rice, potato, bean, corn and sugar and may additionally contain seasonings and spices. The materials may also contain oil or water, but are not kneaded with oil or water and are in a state readily amenable to pulverization. The material for the backing layer may be either dry similarly to the materials for the pattern course or made wet by kneading with oil or water. Both the materials for the pattern course and the material for the backing layer may, as found necessary, further contain an inflating agent and other additives. All the materials supplied into a frame etc. are allowed to set or caused to set by a dding a prescribed water or oil to plasticize them into an integral mass. The integral mass is pressed and then removed from the frame to obtain a raw product. The raw product is then baked. Otherwise, all the materials are baked within the frame etc. With this method, it is possible to produce patterned baked confectionery. It is also possible to produce a patterned shaped article melted by heating, such as a patterned chocolate shaped article etc. by using particles of the material melted by heating, such as chocolate etc. and melting and fusing the particles by heating.

The materials to be used in the method of the present invention are not limited to the aforementioned materials and may be selected depending on the shaped article to be produced. Various shaped articles can be obtained by the use of materials which differ in color, luster, texture and the like in the finished state. Since the sintering step is required in both the methods for the production of a ceramic shaped article and a metal shaped article, if a combination of ceramic materials and metallic materials is used before the sintering step, a cloisonne article can be produced. Since the methods for producing a concrete shaped article and an artificial stone shaped article involve the same step, the materials for the two articles can be combined with each other.

In the method for producing any of the patterned shaped articles, it is desirable to apply vibration when the materials are supplied onto the given surface so as to ensure smooth movement of the materials. Further, by rubbing with a brush or comb or applying a jet of air or water to the portion of the boundary between the different kinds of materials for the pattern course, the pattern can be blurred.

In addition, by providing on the given surface or pattern course a mat of unwoven fabric or other water or oil absorbing material, any excess amount of water, oil, lubricant-bonding agent, plasticizer or solvent can be absorbed and the absorbed amount of water, oil, lubricant-bonding agent, plasticizer or solvent can be supplied to any portion deficient in them to uniformly disperse them in the shaped article. As a result, the ratio of the water (auxiliary agents) in the surface to the cement (resins) becomes small and this means that the strength of the shaped article as a whole is enhanced. When an air permeable mat is used in the formation of an article under pressure, degassing is enhanced to obtain a dense article. By vibrating or pressing one or both of the pattern course and the backing layer when the two layers are allowed to set into an integral article, the integral article obtained becomes dense and is improved in strength. The article may be reinforced with long fibers, short fibers, wire nets or reinforcing rods by inserting these in or between the two layers. The method using an article obtained by the sheet making method or extrusion molding method, any plate or any sheet as the backing layer is applicable to the production of various articles including architectural panels and boards, wall sheets and tiles. The surface of an existing concrete article can be used as the given surface. In this case, the materials for the pattern course are discharged onto the concrete surface and set to be integral with the existing concrete article.

The finished surface of a shaped article to be obtained can be curved if a deformable mat or a partially or entirely deformable frame is used.

The conventional methods require use of an auxiliary frame, masks and the like to obtain a thick pattern. On the other hand, the method of the present invention can produce a thick pattern without using such an auxiliary frame, masks or the like. Thus, the cost for producing a single article can be decreased greatly. As a result, diversified small-quantity production can be attained with ease. An appliance similar to office automation equipment including printers can be used and easily connected to a computer system. Therefore, various patterns such as of dots, lines and planes can be obtained by the aid of software not only in a small area but also in a large area.

The method of the present invention can produce a pattern with acute corners which have been difficult to be produced by inlaying and the like. Further, when the materials are supplied into a layer in advance, a linear or dotted pattern can be formed swiftly. Color can be changed continuously on the spot with ease by adding coloring materials to the sucked material or base-course material prepared in advance.

In addition, according to the method of the present invention using the aforementioned apparatus, it is possible to easily produce concrete shaped articles, artificial stone shaped articles, raw products sintered into ceramic shaped articles, ceramic shaped articles, metal shaped articles, impasto shaped articles, plastic shaped articles and shaped foodstuffs including confectionery each having a pattern of a prescribed thickness formed on part or all of the surface thereof. Therefore, the patterned shaped articles can maintain their patterns in excellent condition even when exposed to surface abrasion. Since the pattern layer is formed by a combination of various kinds of dry materials, the materials can be densely charged without any gap owing to their cave-in action and the boundaries between adjacent materials can be minutely expressed. The pattern formed is thus very clear-cut.

In addition, it is also possible to positively disturb the charged materials either at the boundaries between them or as a whole after the materials have been charged. Doing this enables the production of shaped articles which resemble marble or other kinds of natural stone.

In the case of the production of either a raw product for a ceramic shaped article or a ceramic shaped article, it is possible to produce various kinds of elements, circuits, antennas, etc. with ease by combining at least two kinds of materials for an insulator, conductor, semiconductor, dielectric, piezoelectric device, magnetic substance, etc.

Furthermore, when the produced article is used as an architectural plate, since the plate maintains its pattern even after chamfering, cutting treatment can be effected without any restriction.

What is claimed is:

1. A method for producing a patterned shaped article, comprising the steps of:

disposing a layer of particles on a given surface;

providing on the layer of particles a head having at least one supply port and at least one suction port;

moving the head to trace a pattern to be formed while simultaneously removing a portion of the particles of the layer by suction using the at least one suction port to thereby form a cavity of a clear-cut pattern in the layer of particles on the given surface;

supplying into the cavity of the clear-cut pattern particles different from the removed particles such that the supplied particles can cooperate with the particles of the layer to maintain the clear-cut pattern, the supplied particles being supplied from the at least one supply port, thereby forming the layer into a resultant layer of particles having the clear-cut pattern on the layer, at least some of the particles of the resultant layer being settable particles; and allowing the resultant layer of particles to set on the layer.

2. A method according to claim 1, wherein the at least one supply port supplies particles having recognizably different properties into the cavity.

3. A method according to claim 1, further comprising the step of attaching a backing layer to a surface of the layer of particles opposite the given surface before the setting step.

* * * * *

UNITED STATES PATENT AND TRADEMARK OFFICE

CERTIFICATE OF CORRECTION

PATENT NO. : 5,672,380

DATED : September 30, 1997

INVENTOR(S) : Hiroshi UCHIDA, et al.

It is certified that error appears in the above-identified patent and that said Letters Patent is hereby corrected as shown below:

On the title page, item [30] has been omitted. It should be:

--[30] Foreign Application Priority Data

Sep. 4, 1992 [JP] Japan ..... 4-260492--

Signed and Sealed this

Tenth Day of March, 1998

Bruce Lehman

*Attest:*

BRUCE LEHMAN

*Attesting Officer*

*Commissioner of Patents and Trademarks*